US006783924B2

(12) United States Patent
Weimann et al.

(10) Patent No.: US 6,783,924 B2
(45) Date of Patent: Aug. 31, 2004

(54) COLOUR PHOTOGRAPHIC SILVER HALIDE MATERIAL

(75) Inventors: Ralf Weimann, Leverkusen (DE); Markus Geiger, Cologne (DE); Cuong Ly, Cologne (DE); Klaus Sinzger, Leverkusen (DE); Beate Weber, Leichlingen (DE); Heinz Wiesen, Kieselweg (DE)

(73) Assignee: Agfa-Gevaert (BE)

( * ) Notice: Subject to any disclaimer, the term of this patent is extended or adjusted under 35 U.S.C. 154(b) by 0 days.

(21) Appl. No.: 10/612,560

(22) Filed: Jul. 2, 2003

(65) Prior Publication Data

US 2004/0110103 A1 Jun. 10, 2004

(30) Foreign Application Priority Data

Jul. 10, 2002 (DE) ..... 102 30 980

(51) Int. Cl.[7] ..... G03C 1/08; G03C 7/26; G03C 7/32

(52) U.S. Cl. ..... 430/553; 430/552; 430/384; 430/385

(58) Field of Search ..... 430/384, 385, 430/552, 553, 567, 551, 607, 611, 613

(56) References Cited

U.S. PATENT DOCUMENTS

| | | | | |
|---|---|---|---|---|
| 5,919,612 | A | 7/1999 | Ly et al. | |
| 5,922,526 | A | 7/1999 | Missfeldt | 430/584 |
| 6,534,254 | B1 * | 3/2003 | Helling et al. | 430/552 |
| 6,558,887 | B2 * | 5/2003 | Helling et al. | 430/552 |
| 2002/0051945 | A1 | 5/2002 | Begley et al. | |
| 2003/0064331 | A1 | 4/2003 | Ly et al. | 430/552 |

FOREIGN PATENT DOCUMENTS

| | | |
|---|---|---|
| DE | 196 34 385 | 7/1997 |
| DE | 196 46 855 | 5/1998 |
| DE | 100 55 094 | 5/2002 |
| EP | 0 571 959 | 12/1993 |
| EP | 1 113 327 | 7/2001 |
| EP | 1 113 329 | 7/2002 |
| GB | 2 316 495 | 2/1998 |

* cited by examiner

*Primary Examiner*—Geraldine Letscher
(74) *Attorney, Agent, or Firm*—Connolly Bove Lodge & Hutz LLP

(57) ABSTRACT

A color photographic silver halide material comprising a substrate, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the silver halide crystals of the red-sensitive layer have a chloride content of at least 95 mol %, the cyan coupler corresponding to formula (I)

wherein $R^1$ represents a hydrogen atom or an alkyl group, $R^2$ represents an alkyl, aryl or hetaryl group $R^3$ represents an alkyl or aryl group, $R^4$ represents an alkyl, alkenyl, alkoxy, aryloxy, acyloxy, acylamino, sulphonyloxy, sulphamoylamino, sulphonamido, ureido, hydroxycarbonyl, hydroxycarbonylamino, carbamoyl, alkylthio, arylthio, alkylamino or arylamino group or a hydrogen atom and Z represents a hydrogen atom or a group which may be split off under the conditions of chromogenic development and the red-sensitive layer contains at least one compound of formula (II)

wherein $R^5$ represents H, $CH_3$ or $OCH_3$, $R^6$ represents H, OH, $CH_3$, $OCH_3$, NHCO—$R^7$, COOR$^7$, $SO_2NH_2$, $NHCONH_2$ or NHCONH—$CH_3$ and $R^7$ represents $C_1$ to $C_4$ alkyl, is distinguished by very good stability in storage simultaneously with very good latent image stability.

16 Claims, No Drawings

COLOUR PHOTOGRAPHIC SILVER HALIDE MATERIAL

The invention relates to a colour photographic silver halide material comprising a novel cyan coupler and a chloride-rich silver halide emulsion which is particularly suitable as copying material.

Colour photographic copying materials are, in particular, materials for images to be viewed by reflection or displays which generally have a positive image. They are therefore not recording materials such as colour photographic films.

Colour photographic copying materials conventionally contain at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler.

Photographic copying material, such as colour photographic paper, is produced in a few production sites from where it is sent all over the world and is finally processed by exposure and processing into colour photographic prints. Between production and processing the material is stored for different lengths of time and under a wide variety of conditions. Cold storage and cold transportation prescribed by the producer not only result in high costs but are also frequently not adhered to, This is detrimental to the quality of the colour prints and leads to complaints.

There is therefore a need to produce colour photographic materials, in particular colour photographic paper, which does not require cold storage and also does not exhibit sensitometric changes, in particular in the red-sensitive layers, over a prolonged period of storage at 20 to 50° C.

It is known from DE 19 634 385 that, by combining a certain pentamethine cyanin red sensitiser with at least two specific stabilisers, the stability in storage, in particular the gradation stability, of unprocessed colour copying material, may be improved. However, this measure leads to unsatisfactory latent image stability.

However, in copying material according to the prior art, the latent image stability is still unsatisfactory.

The object of the invention was to overcome the disadvantage described above and to thus obtain materials which have very good latent image stability as well as very good stability in storage. Surprisingly, this has been achieved with the cyan coupler defined hereinafter, chloride-rich silver halide emulsions and certain stabilisers.

(I)

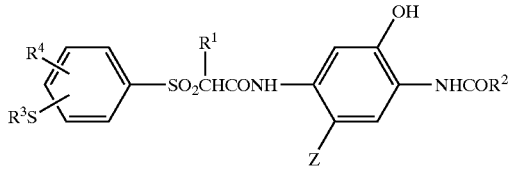

wherein $R^1$ represents a hydrogen atom or an alkyl group, $R^2$ represents an alkyl, aryl or hetaryl group $R^3$ represents an alkyl or aryl group, $R^4$ represents an alkyl, alkenyl, alkoxy, aryloxy, acyloxy, acylamino, sulphonyloxy, sulphamoylamino, sulphonamido, ureido, hydroxycarbonyl, hydroxycarbonylamino, carbamoyl, alkylthio, arylthio, alkylamino or arylamino group or a hydrogen atom and Z represents a hydrogen atom or a group which may be split off under the conditions of chromogenic development and the red-sensitive layer contains at least one compound of formula (II)

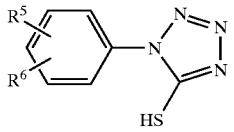

wherein $R^5$ represents H, $CH_3$ or $OCH_3$, $R^6$ represents H, OH, $CH_3$, $OCH_3$, NHCO—$R^7$, $COOR^7$, $SO_2NH_2$, NHCONH2 or NHCONH—$CH_3$ and $R^7$ represents $C_1$ to $C_4$ alkyl The compound (II) is preferably added in an amount of 50 to 5,000 mg per kg Ag and particularly preferably in an amount of 200 to 2,000 mg per kg Ag of the red-sensitive layer.

The cyan coupler particularly preferably corresponds to the formula (I-A)

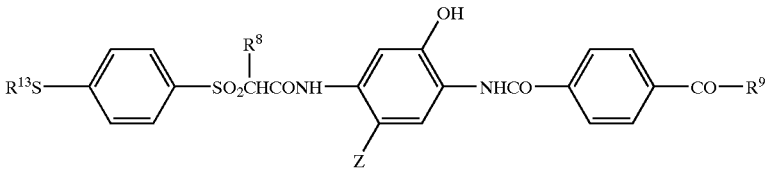

The invention therefore relates to a colour photographic silver halide material comprising a substrate, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the silver halide crystals of the red-sensitive layer have a chloride content of at least 95 mol %, the cyan coupler corresponding to the formula wherein $R^8$ represents a hydrogen atom or an alkyl group $R^9$ represents $OR^{10}$ or $NR^{11}R^{12}$, $R^{10}$ represents an unsubstituted or substituted alkyl group with 1 to 6 carbon atoms, $R^{11}$ represents an unsubstituted or substituted alkyl group with 1 to 6 carbon atoms, $R^{12}$ represents a hydrogen atom or an unsubstituted or substituted alkyl group with 1 to 6 carbon atoms, $R^{13}$ represents an unsubstituted or substituted alkyl group and Z represents a hydrogen atom or a group which may be split off under the conditions of chromogenic development, wherein the total number of carbon atoms of the alkyl groups $R^{10}$ to $R^{13}$ in a coupler molecule is 8 to 18.

The alkyl groups can be straight chain, branched or cyclic and the alkyl, aryl and hetaryl groups can be substituted, for example, by alkyl, alkenyl, alkyne, alkylene, aryl, heterocyclyl, hydroxy, carboxy, halogen, alkoxy, aryloxy, heterocyclyloxy, alkylthio, arylthio, heterocyclylthio, alkylseleno, arylseleno, heterocyclylseleno, acyl, acyloxy, acylamino, cyano, nitro, amino, thio or mercapto groups, wherein a heterocyclyl represents a saturated, unsaturated or aromatic heterocyclic radical and an acyl represents the radical of an aliphatic, olefinic or aromatic carboxylic, carbamic, carbonic, sulphonic, amidosulphonic, phosphoric, phosphonic, phosphorous, phosphinic or sulphinic acid.

Preferably the alkyl groups can be substituted, for example, by alkyl, alkylene, hydroxy, alkoxy or acyloxy groups and most preferably by hydroxy or alkoxy groups. Preferred substituents for aryl and hetarylgroups are halogen, in particular Cl and F, alkyl, fluorinated alkyl, cyano, acyl, acylamino or carboxy groups.

Suitable cyan couplers are:

I-1

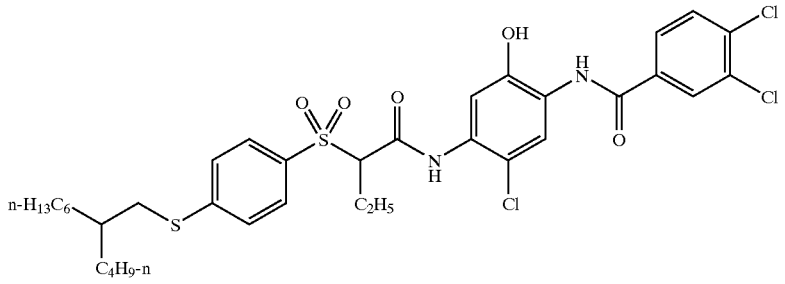

I-2

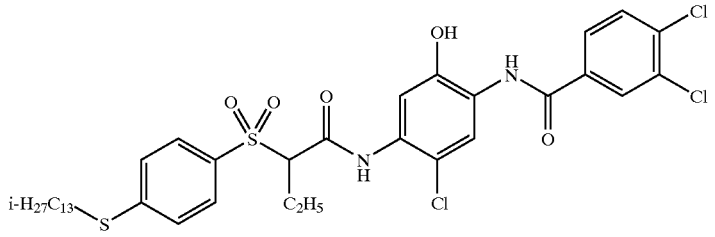

I-3

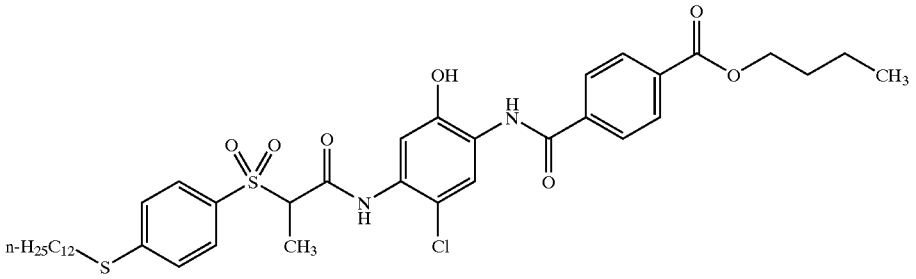

I-4

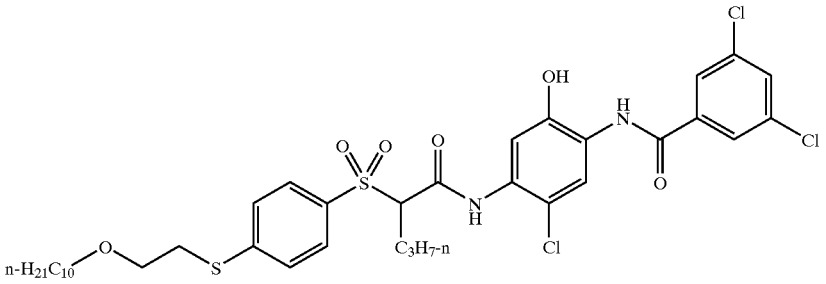

-continued
I-5
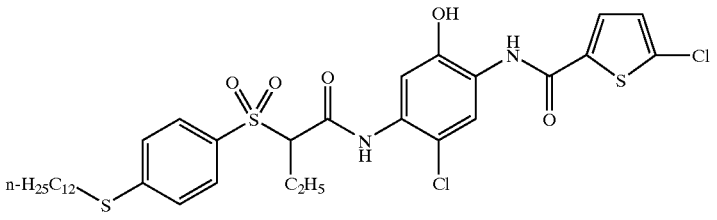
I-6
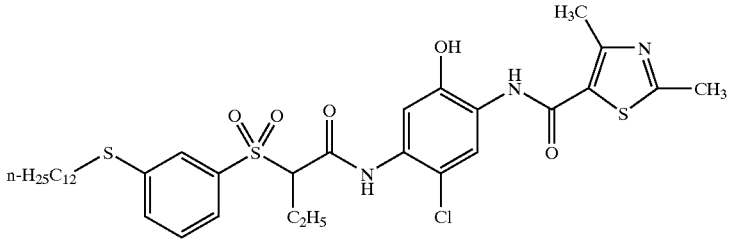
I-7
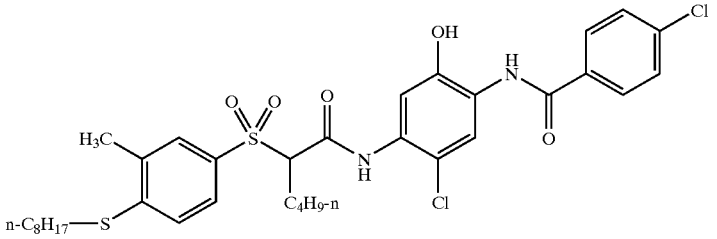
I-8
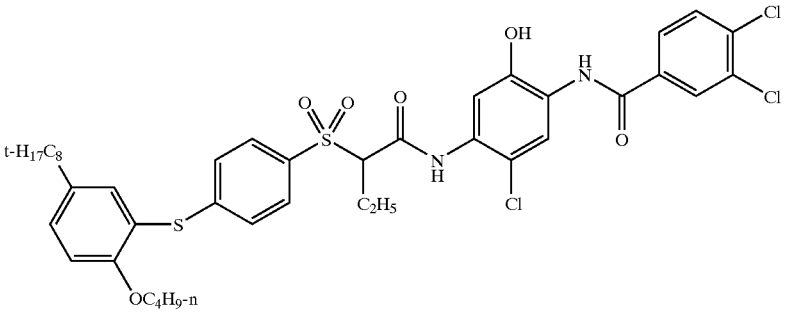
I-9
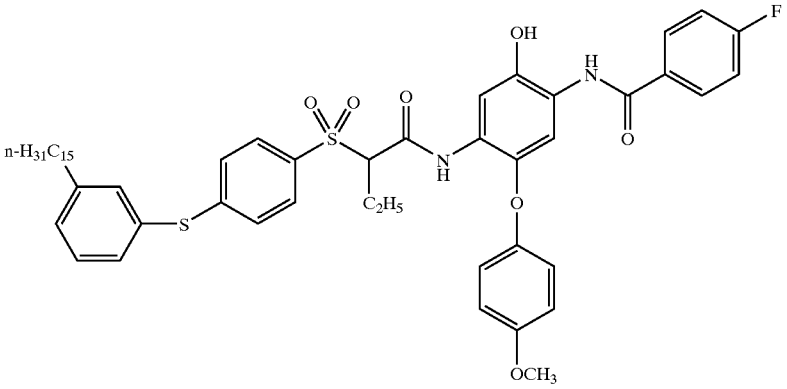

-continued
I-10
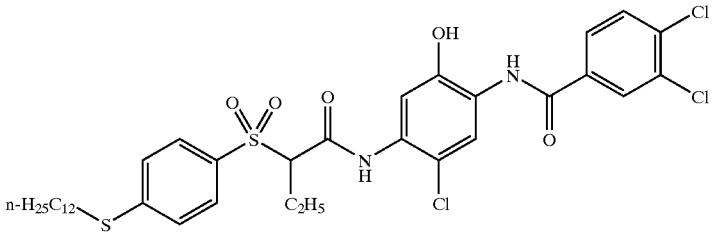
I-11
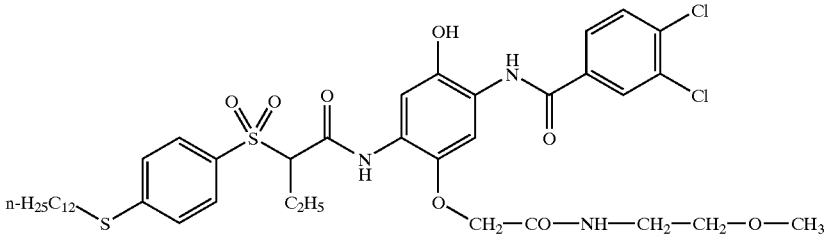
I-12
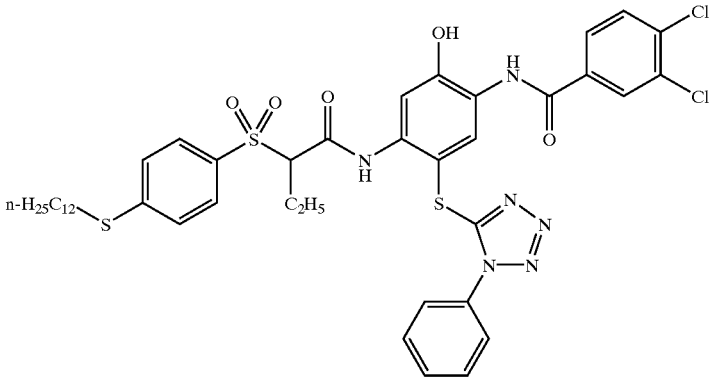
I-13
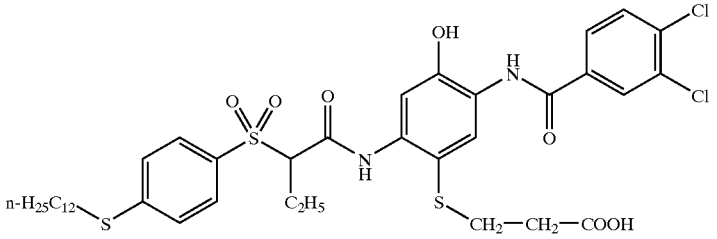
I-14
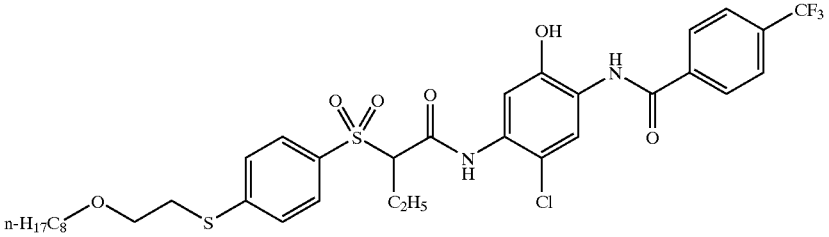

-continued
I-15
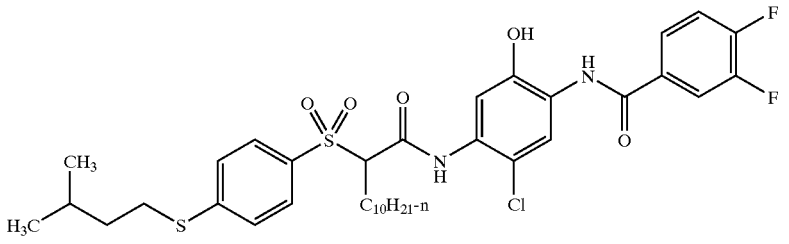
I-16
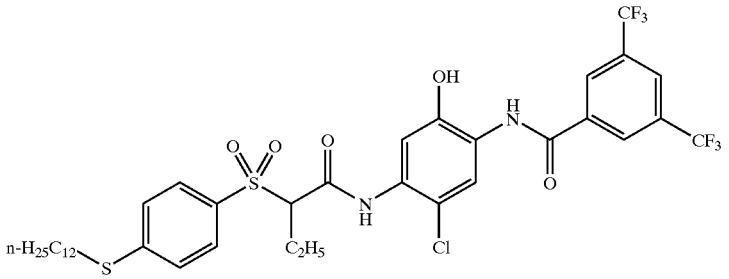
I-17
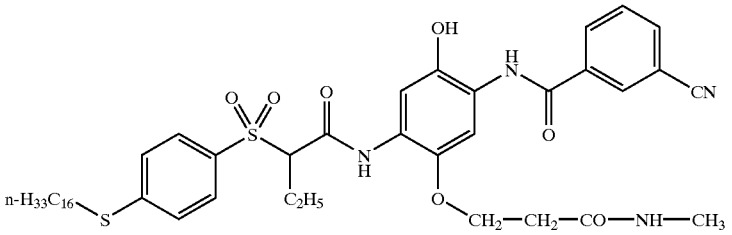
I-18
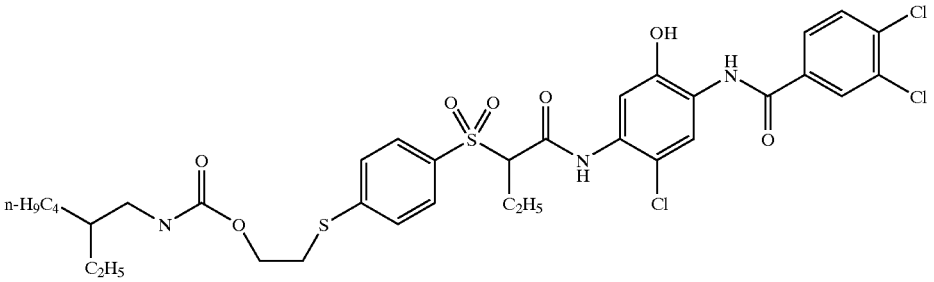
I-19
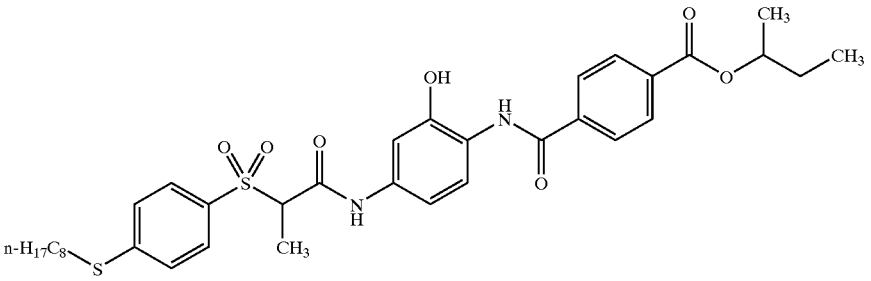

-continued
I-20
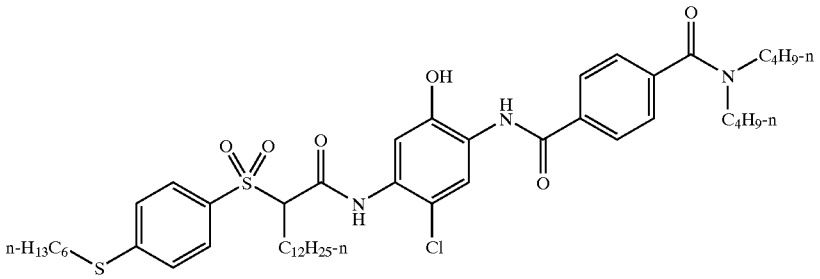
I-21
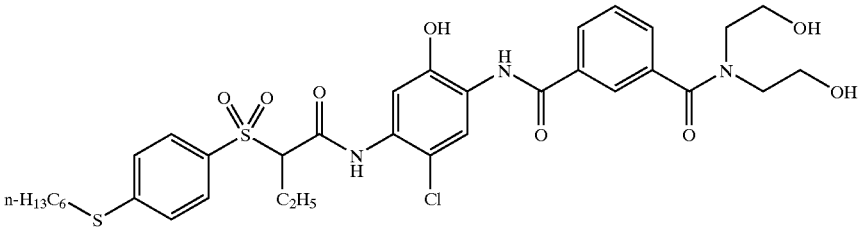
I-22
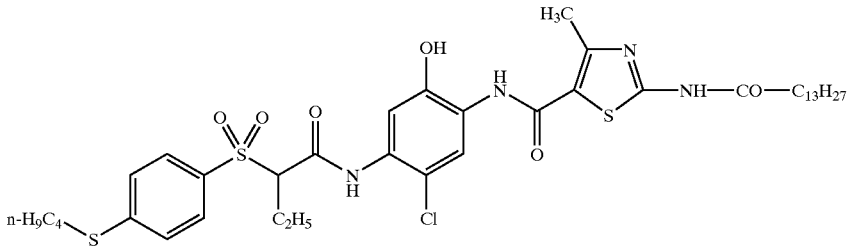
I-23
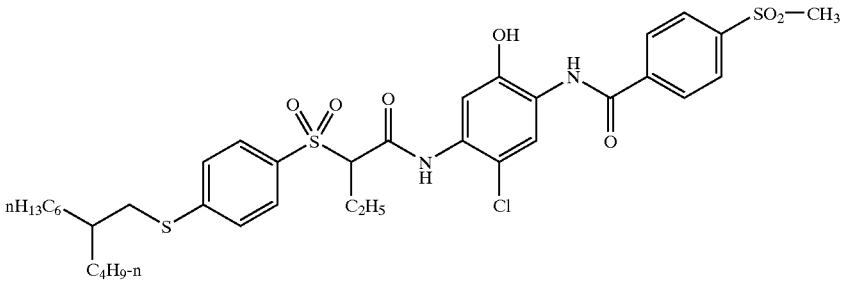
I-24
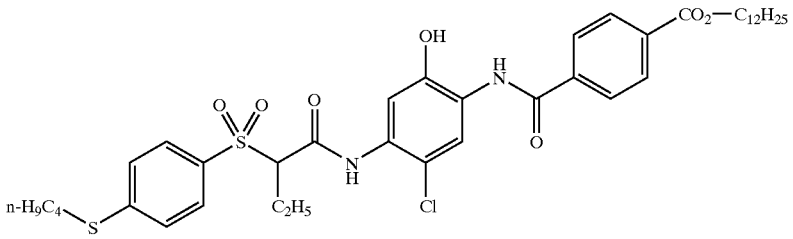
I-25
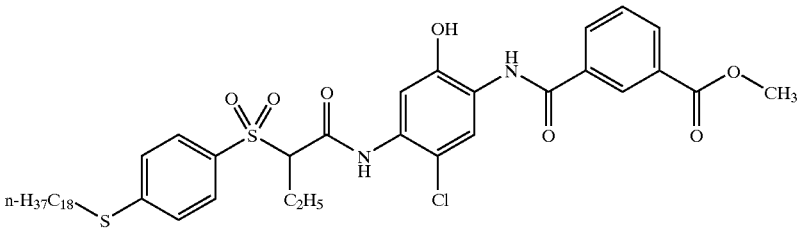

-continued
I-26
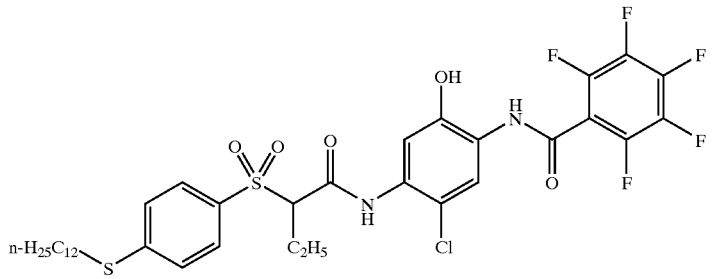
I-27
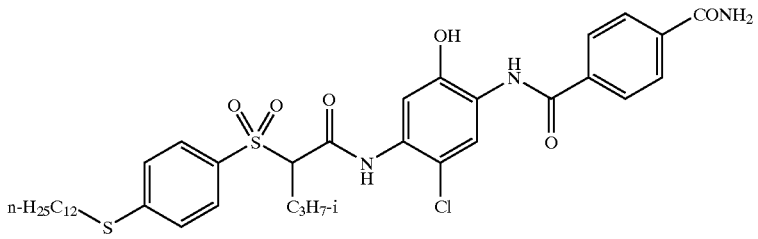
I-28
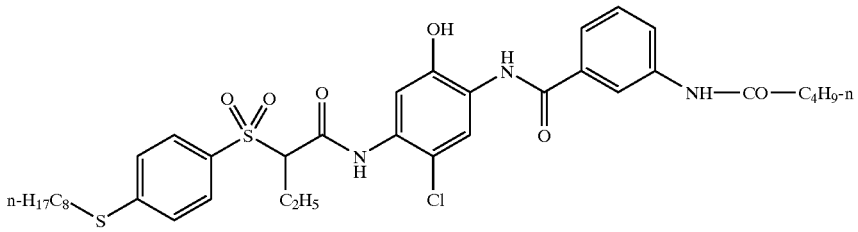
I-29
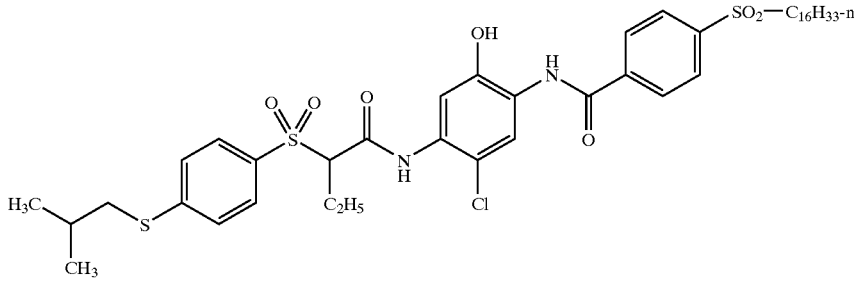
I-30
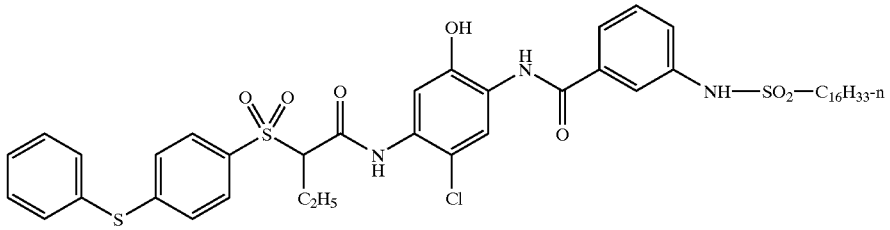
I-31
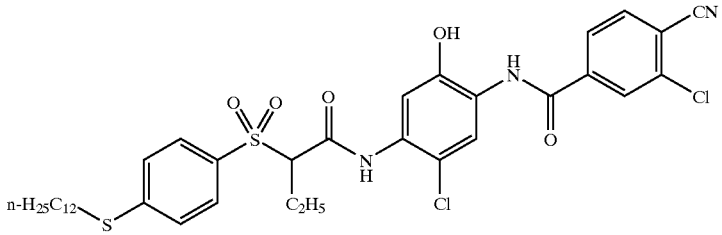

-continued
I-32
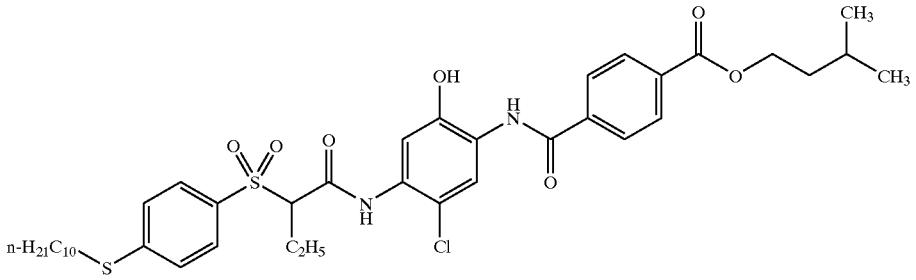
I-33
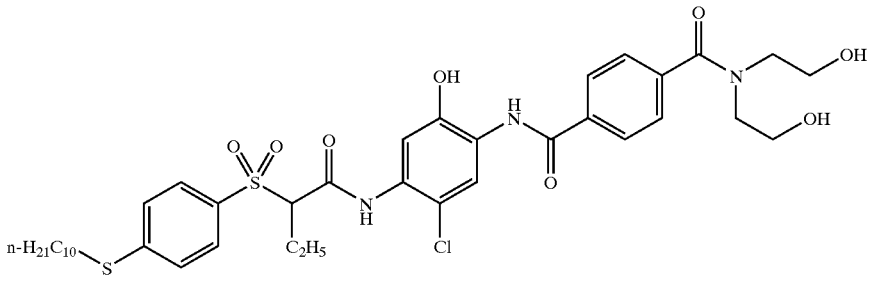
I-34
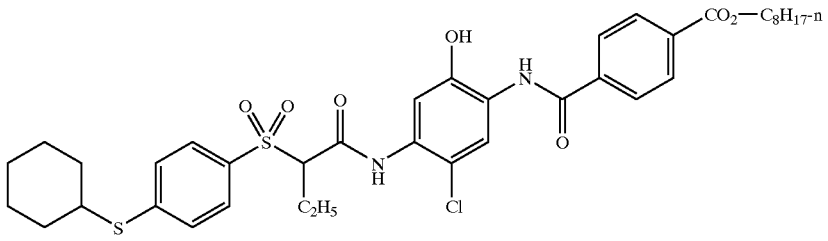
I-35
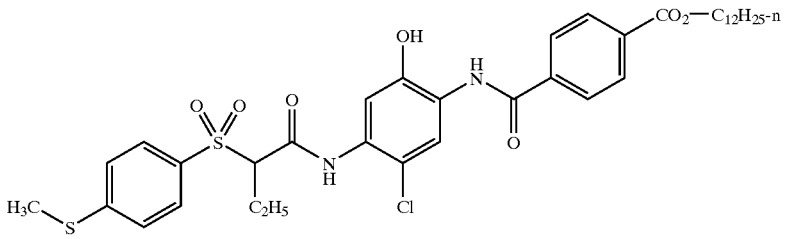
I-36
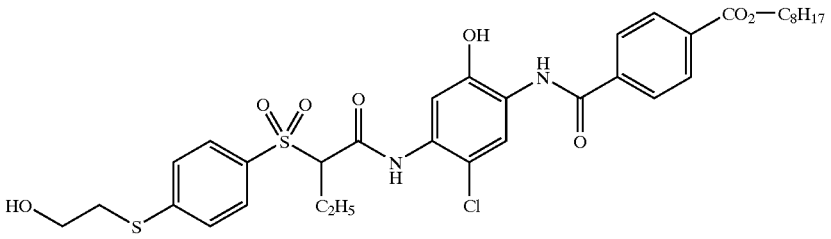
I-37
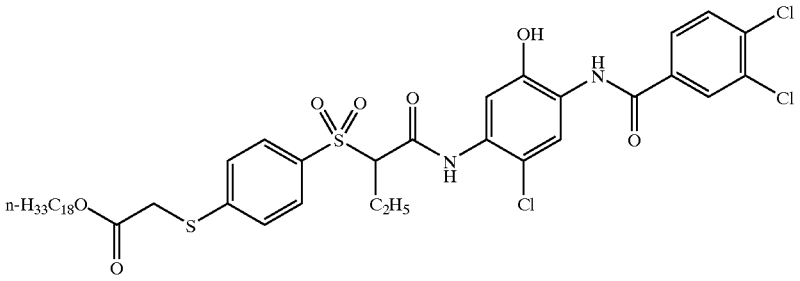

-continued

I-38

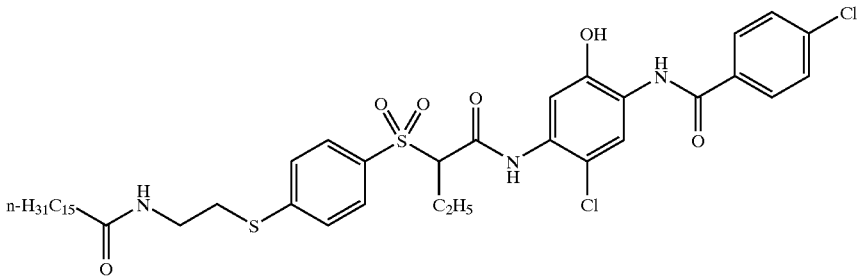

I-39

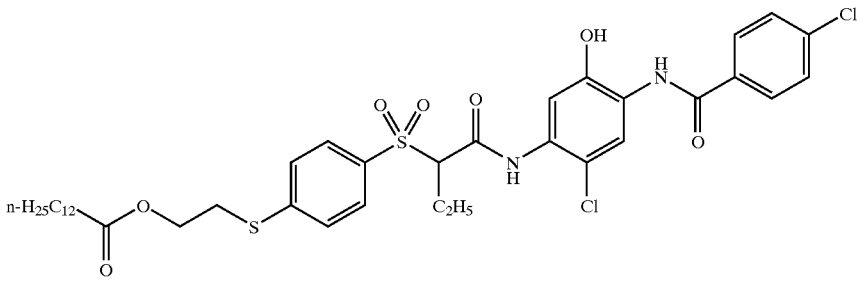

I-40

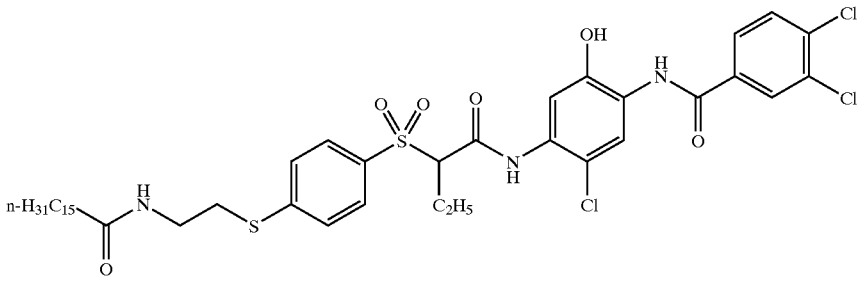

Synthesis of Couplers I-10

Synthesis of the Phenolic Coupler Intermediate Stage

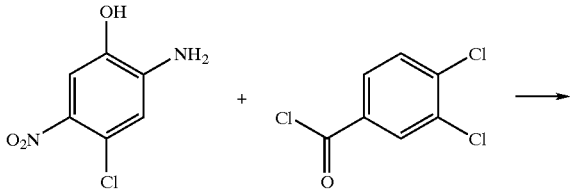

1 2

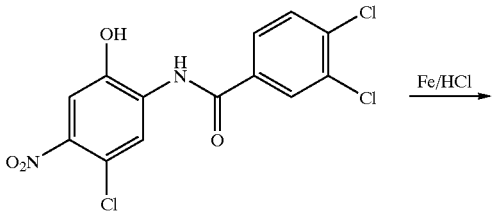

3

-continued

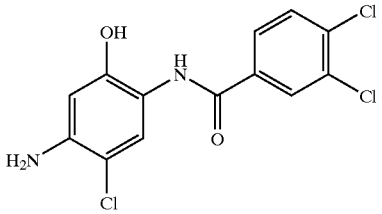

4

A solution of 185 g (0.87 mol) 3,4-dichlorobenzoylchloride 2 in 50 ml N-methylpyrrolidone was added dropwise while stirring to 165 g (0.87 mol) 2-amino-4-chloro-5-nitrophenol 1 in 500 ml N-methylpyrrolidone. The mixture was subsequently stirred for 1 hour at ambient temperature and then for 2 hours at 60 to 65° C. After cooling 500 ml water were slowly added and suction filtered. The mixture was then stirred twice with water, then twice with methanol and suction filtered.

Yield 310 g (98%) 3.

A mixture of 310 g (0.86 mol) 3, 171 g iron powder, 2.2 l ethanol and 700 ml N-methylpyrrolidone were heated to 65° C. while stirring. The heating bath was removed and 750 ml concentrated hydrochloric acid were added dropwise within 2 hours. The mixture was then refluxed for 1 hour. After cooling, 1 l water was added and suction filtered, the mixture washed with 2 N hydrochloric acid then with water until the discharge water was colourless. The residue was stirred with 1:5 l water, neutralised by the addition of sodium acetate and suction filtered. The mixture was stirred again twice with 1.5 l methanol and suction filtered.

Yield 270 g (95%) 4.

Synthesis of the Ballast Residue

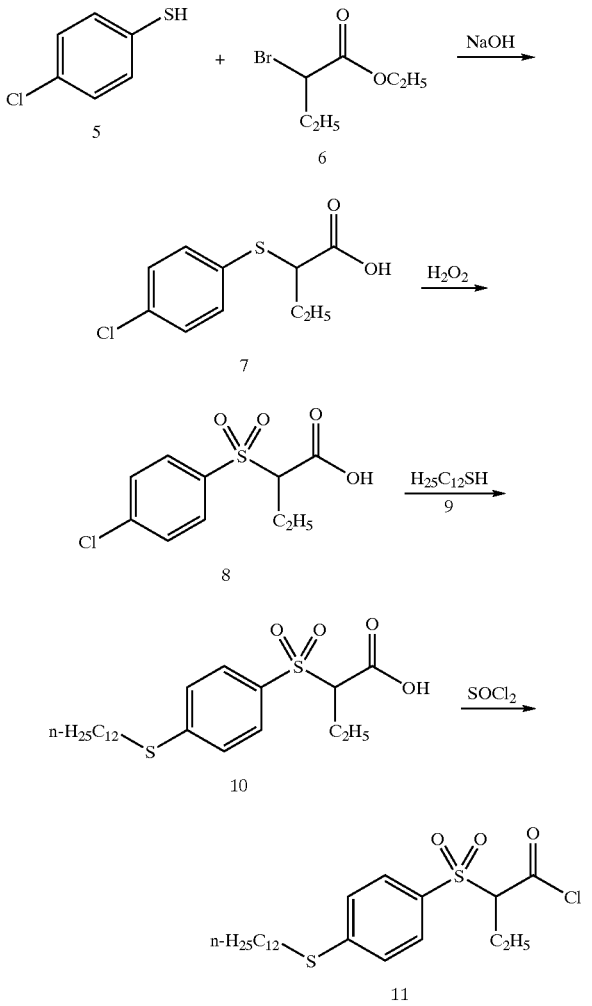

320 g (3.6 mol) 45% sodium hydroxide solution were added dropwise while stirring within 1 hour to a mixture of 520 g (3.6 mol) 4-chlorothiophenol 5 and 652 g (3.6 mol) 2-bromoethylbutyrate 6 in 1 l ethanol. The reaction was strongly exothermic, the temperature was kept at 75 to 80° C. by cooling, and the mixture was then refluxed for 1 hour. A further 400 g (4.5 mol) sodium hydroxide solution were slowly added (weakly exothermic). After a further 2 hours of refluxing the mixture was cooled and 1 l water was added to it. The mixture was then extracted twice with 250 ml toluene, and the purified organic phases were dried and evaporated on the rotary evaporator. The viscous oil 7 (830 g, still containing toluene) was further reacted without purification.

760 ml hydrogen peroxide (35%) were added dropwise to a solution of 830 g (3.6 mol) of compound 7 and 10 ml sodium tungstate solution (20%) in glacial acetic acid: the first 300 ml initially with cooling at 35 to 40° C., the remaining 360 ml at 90 to 95° C. after removal of the cooling. Once the addition was complete the mixture was subsequently stirred at this temperature for 1 hour. Excess peroxide was destroyed by the addition of sodium sulphite. 2 l ethyl acetate and 2 l water were added to the reaction mixture, the organic phase was separated off and the aqueous phase extracted twice with 700 ml ethyl acetate respectively. The combined organic phases were washed twice with 700 ml water respectively, dried and evaporated under vacuum. The residue was dissolved hot in 300 ml ethyl acetate, cooled and combined with 1 l hexane at the start of crystallisation. The mixture was then suction filtered cold and rewashed with a little hexane. 835 g (88%) of compound 8 were obtained.

131 g (0.5 mol) 8 and 111 g (0.55 mol) dodecylmercaptan 9 were introduced into 300 ml 2-propanol while stirring with 90 g (1 mol) sodium hydroxide solution (45%). After addition of 2.5 g tetrabutylammonium bromide and 2.5 g potassium iodide, the mixture was refluxed for 11 hours. After cooling 350 ml water were added, and the pH was adjusted to 1 to 2 with about 60 ml concentrated hydrochloric acid. The mixture was then extracted twice with 100 ml ethyl acetate, the combined organic phases were washed three times with 150 ml water respectively, dried and evaporated. The residue was stirred with 500 ml hexane and suction filtered at 0 to 5° C. After recrystallisation 177 g 10 (82%, mp.: 82° C.) were obtained from 500 ml hexane/ethyl acetate (10:1).

128 g (0.3 mol) 10 and 1 ml dimethylformamide were heated in 300 ml toluene to 65° C. 75 ml (1 mol) thionylchloride were added dropwise at this temperature within 1 hour. After a further 5 hours the mixture was evaporated under vacuum. The highly viscous oil (11, 134 g) was used without further purification.

Synthesis of the Coupler 1–10

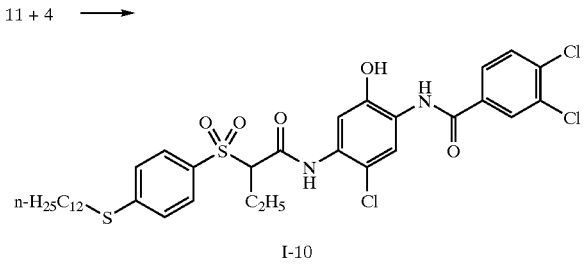

100 g raw product 11 (about 0.2 mol) in 100 ml N-methylpyrrolidone were added dropwise at 5 to 10° C. to 66 g (0.2 mol) 4 in 200 ml N-methylpyrrolidone. The mixture was initially stirred for 2 hours at ambient temperature then for 2 hours at 60° C. The reaction mixture was filtered hot, 500 ml acetonitrile added to the filtrate, the mixture cooled to 0° C., suction filtered and then washed with 50 ml acetonitrile. The product was combined with 500 ml methanol and 1 l water, stirred, suction filtered, then rewashed with 300 ml water and dried.

Yield: 120 g (81%) I-10.

The red-sensitive layer may contain silver chloride, silver chloride bromide, silver chloride iodide or silver chloride bromide iodide crystals. It is particularly preferably a silver chloride bromide emulsion with a chloride content of at least 95 mol % and particularly preferably of at least 97 mol %.

Preferred compounds of formula (II) are listed hereinafter:

| | $R^5$ | $R^6$ |
|---|---|---|
| II-1 | H | H |
| II-2 | H | o-$OCH_3$ |
| II-3 | H | m-$OCH_3$ |
| II-4 | H | p-$OCH_3$ |
| II-5 | H | o-OH |
| II-6 | H | m-OH |
| II-7 | H | p-OH |
| II-8 | H | m-$NHCOCH_3$ |
| II-9 | H | p-$COOC_2H_5$ |
| II-10 | H | p-COOH |
| II-11 | H | m-$NHCONH_2$ |
| II-12 | H | p-$SO_2NH_2$ |
| II-13 | o-$OCH_3$ | p-$OCH_3$ |
| II-14 | H | m-$NHCONHCH_3$ |

In a preferred embodiment the red-sensitive layer additionally contains a compound of the formula (III)

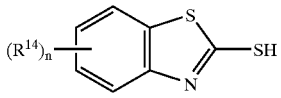

wherein $R^{14}$ represents a substituent and n represents a number 1, 2 or 3.

The compound of formula (III) is preferably contained in the red-sensitive layer in an amount of 100 to 5,000 mg per kg Ag and in particular in an amount of 500 to 3,000 mg per kg Ag.

Particularly suitable stabilisers of formula (III) are those in which $R^{14}$ has the meaning

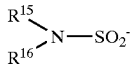

and $R^{15}$ and $R^{16}$ independently of one another represent H, Cl, $C_1$ to $C_4$ alkyl, phenyl or chlorophenyl.

A compound of formula

III-1

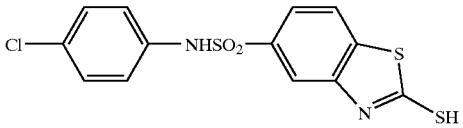

is particularly preferred.

In a particularly preferred embodiment the red-sensitive layer contains a red sensitiser of formula (IV)

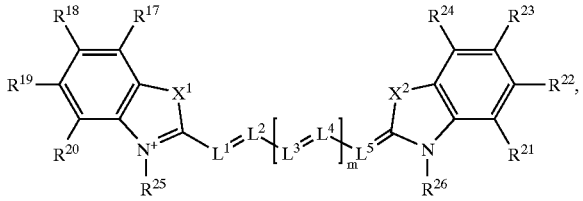

M wherein $R^{17}$ to $R^{24}$ represent H, alkyl, alkoxy, halogen, aryl, CN, 2- or 3-thienyl, N-pyrrolyl, N-indolyl, benzthienyl, $CF_3$, 2- or 3-furanyl or $R^{18}$ and $R^{19}$ or $R^{19}$ and $R^{20}$ or $R^{21}$ and $R^{22}$ or $R^{22}$ and $R^{23}$ represent the remaining members of a carbocyclic ring system.

$X^1$ and $X^2$ represent O, S, Se or N—$R^{27}$, $R^{25}$ and $R^{26}$ represent optionally substituted alkyl or $R^{23}$ together with $L^1$ or $R^{26}$ together with $L^5$ represent the remaining members of a 5- to 7-membered saturated or unsaturated ring, $L^1$ to $L^5$ represent optionally substituted methine groups or $L^2$, $L^3$ and $L^4$ together represent the members of a 5- to 7-membered ring, m represents 0 or 1

$R^{27}$ represents $C_1$ to $C_4$ alkyl and

M represents a counterion optionally necessary for charge compensation, wherein $X^1$ and $X^2$ independently of one another represent S or Se if m is 0.

The compounds of formula (IV) are preferably contained in the red-sensitive layer in an amount of 5 to 250 $\mu$mol per mol silver halide and particularly preferably in an amount of 50 to 200 $\mu$mol per mol silver halide.

Particularly preferred sensitisers of formula (IV) are given hereinafter:

(IV-1)

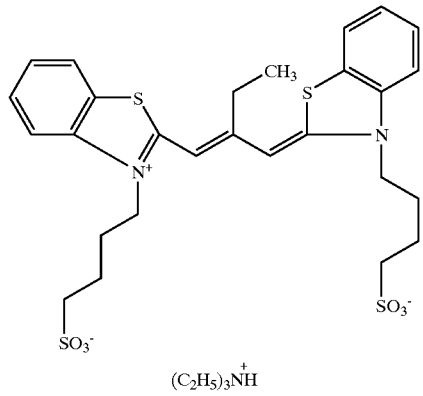

-continued (IV-2)

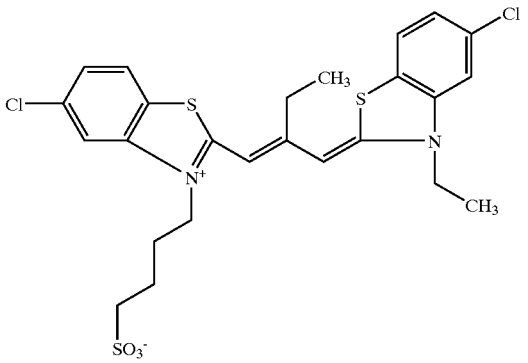

(IV-3)

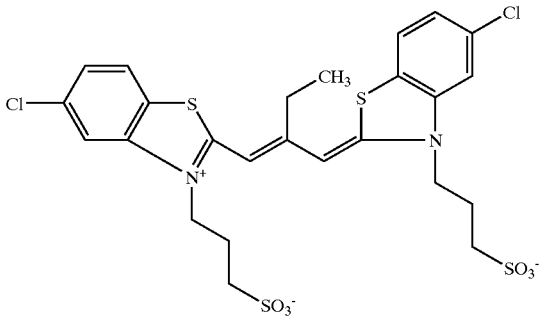

$(C_2H_5)_3\overset{+}{N}H$ (IV-4)

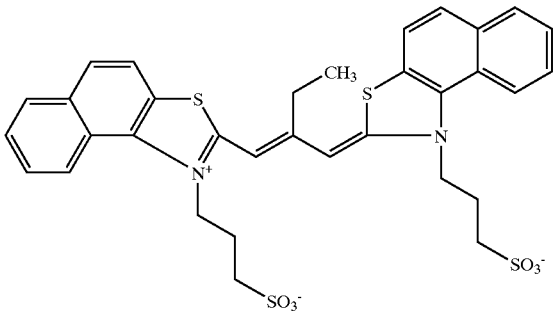

$K^+$ (IV-5)

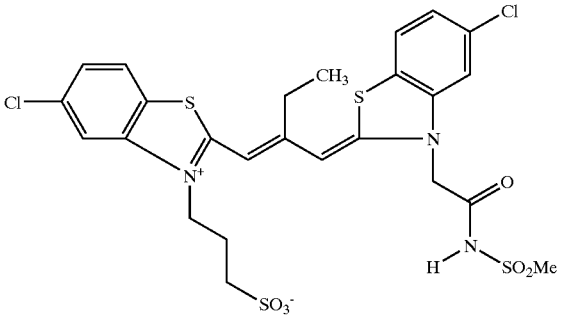

-continued (IV-6)

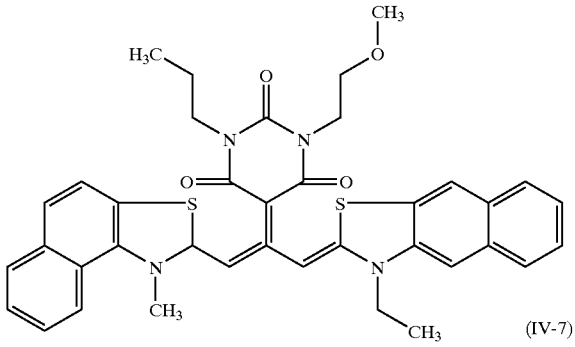

(IV-7)

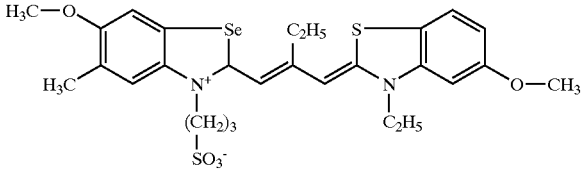

In a particularly advantageous embodiment of the invention the sensitisers of formula (IV) are those of formula (IV-A)

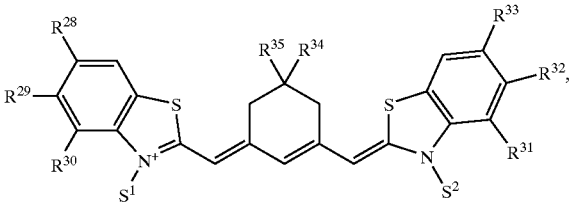

M wherein $S^1$, $S^2$ independently of one another represent optionally substituted alkyl, sulphoalkyl, carboxyalkyl, —$(CH_2)$—$SO_2$—NY—$SO_2$-alkyl, —$(CH_2)$—$SO_2$—NY—CO-alkyl, —$(CH_2)$—CO—NY—$SO_2$-alkyl, —$(CH_2)$—CO—NY—CO-alkyl, Y represents a negative charge or a hydrogen atom, $R^{28}$, $R^{29}$, $R^{30}$, $R^{31}$, $R^{32}$, $R^{33}$ independently of one another represent H, alkyl, alkoxy, halogen, aryl, CN, 2- or 3-thienyl, N-pyrrolyl, N-indolyl, benzthienyl, $CF_3$, 2- or 3-furanyl or $R^{28}$ and $R^{29}$ or $R^{29}$ and $R^{30}$ or $R^{31}$ and $R^{32}$ or $R^{32}$ and $R^{33}$ represent the remaining members of a benzo or naphtho ring, $R^{34}$, $R^{35}$ independently of one another represent H, alkyl, aryl or hetaryl and M represents a counterion optionally required for charge compensation.

Particularly favourable properties are achieved if the red-sensitive layer, in addition to sensitisers of formula (IV-A), additionally contains those of formula (IV-B)

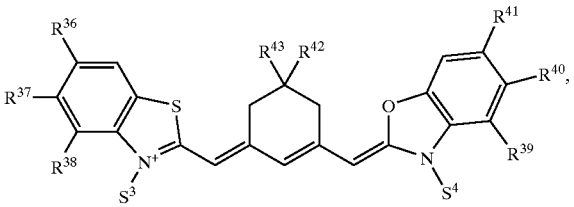

M wherein $S^3$, $S^4$ independently of one another have the same meaning as $S^1$, $S^2$, $R^{42}$, $R^{43}$ independently of one another have the same meaning as $R^{34}$, $R^{35}$, $R^{36}$, $R^{37}$, $R^{38}$, $R^{39}$, $R^{40}$ and $R^{41}$ have the same meaning as $R^{28}$ to $R^{33}$ and M represents a counterion optionally required for charge compensation.

Suitable sensitisers of formulae (IV-A) and (IV-B) are given hereinafter:

(IV-A-1)

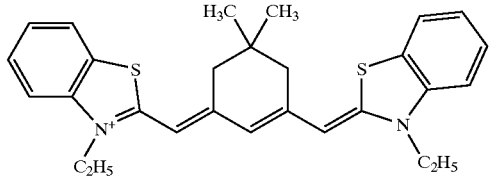

(IV-A-2)

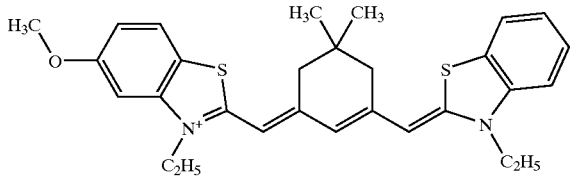

(IV-A-3)

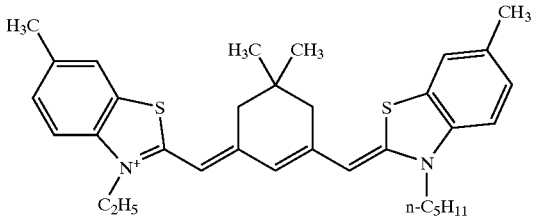

(IV-A-4)

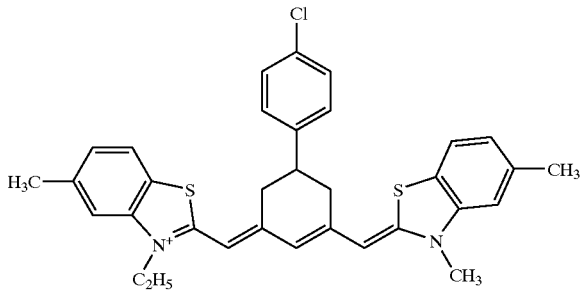

-continued (IV-A-5)

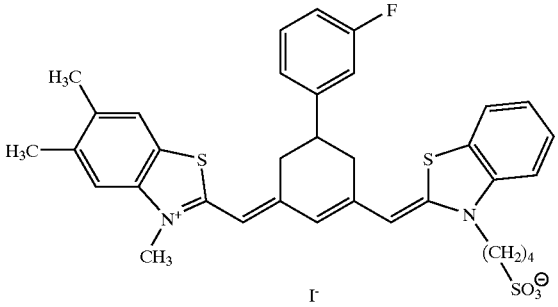

(IV-A-6)

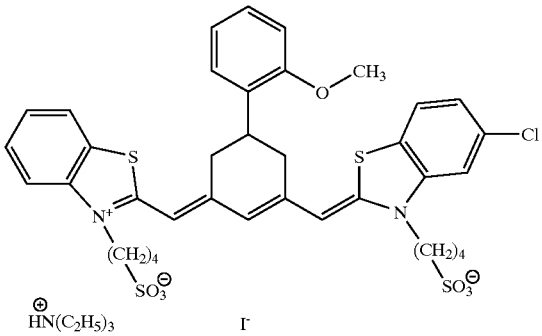

(IV-A-7)

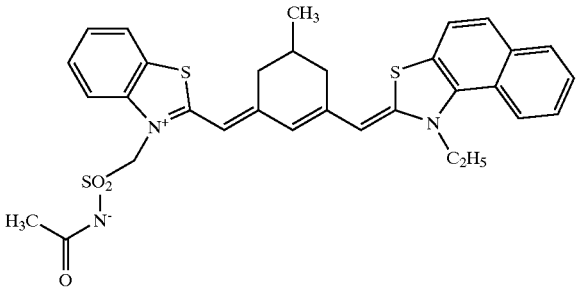

(IV-A-8)

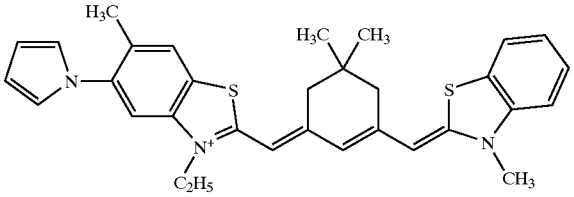

(IV-A-9)

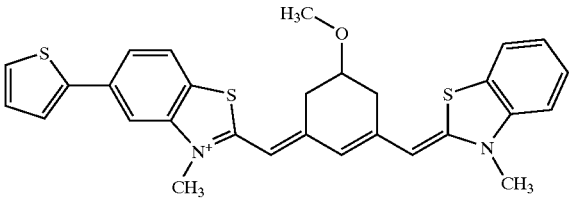

-continued
(IV-A-10)
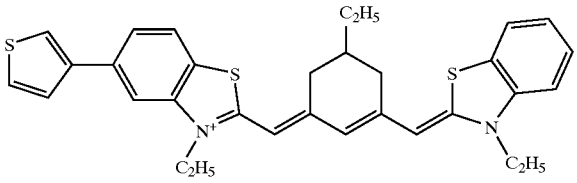
I⁻
(IV-A-11)
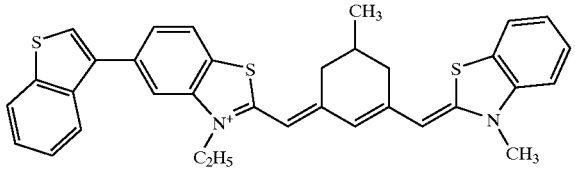
I⁻
(IV-A-12)
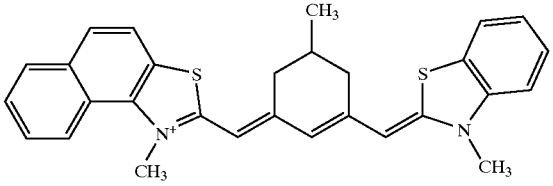
TosO⁻
(IV-A-13)
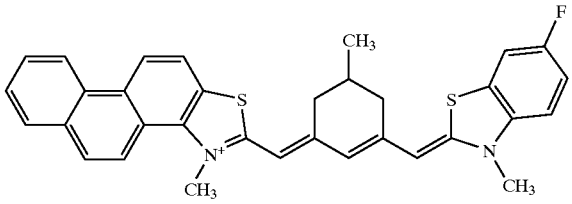
TosO⁻
(IV-A-14)
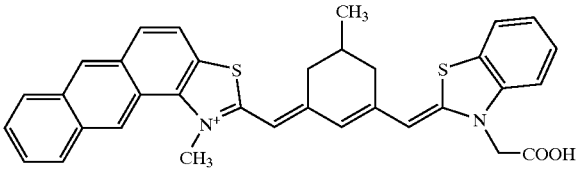
TosO⁻
(IV-A-15)
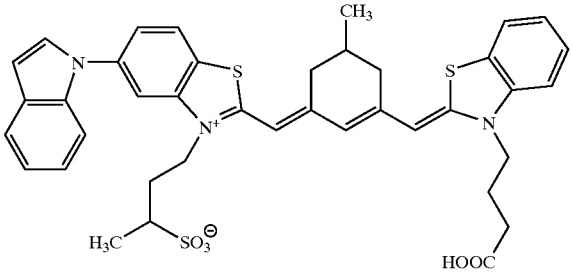
TosO⁻
-continued
(IV-A-16)
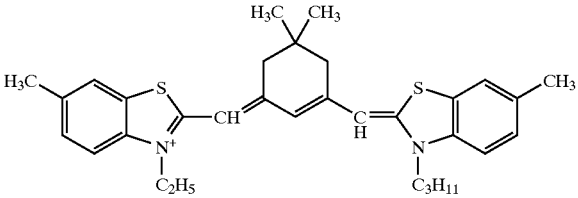
I⁻
(IV-A-17)
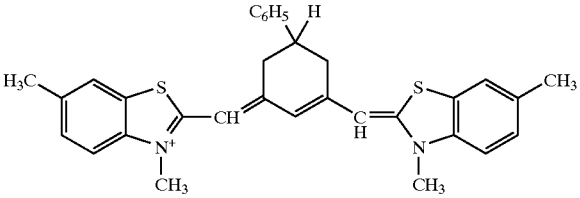
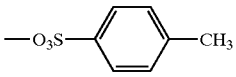
(IV-B-1)
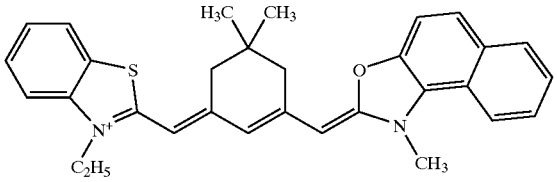
I⁻
(IV-B-2)
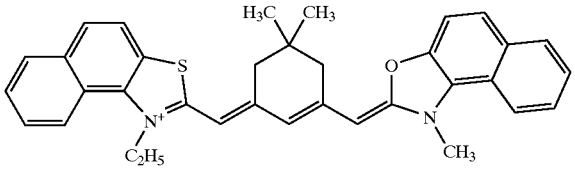
I⁻
(IV-B-3)
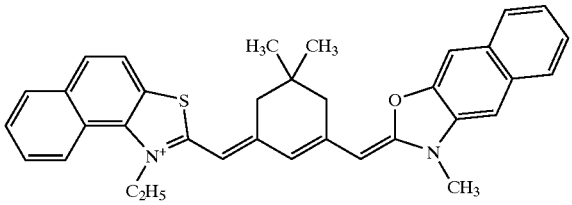
I⁻
(IV-B-4)
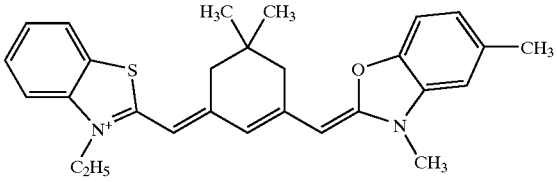
I⁻

-continued
(IV-B-5)
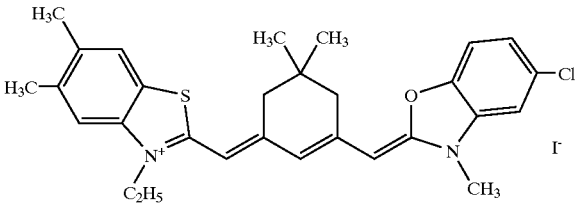
(IV-B-6)
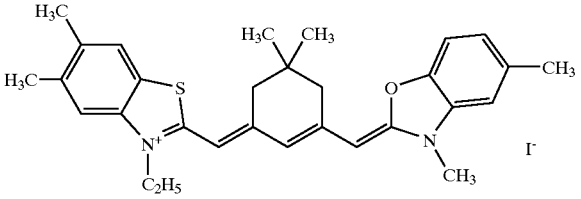
(IV-B-7)
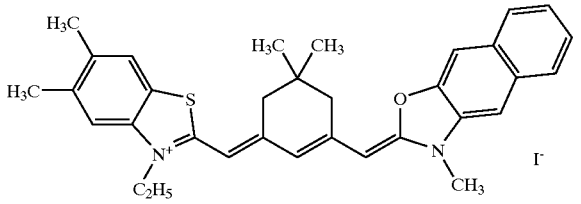
(IV-B-8)
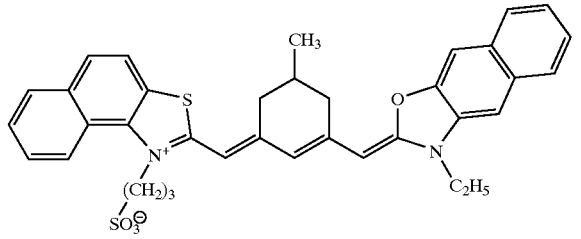
(IV-B-9)
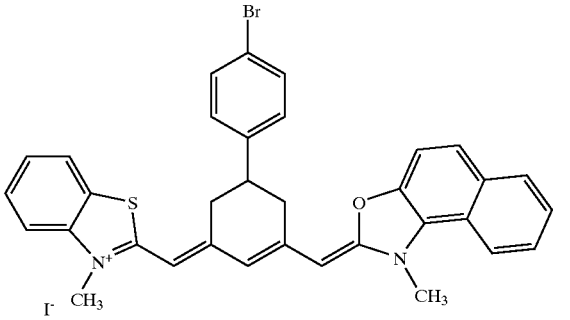
(IV-B-10)
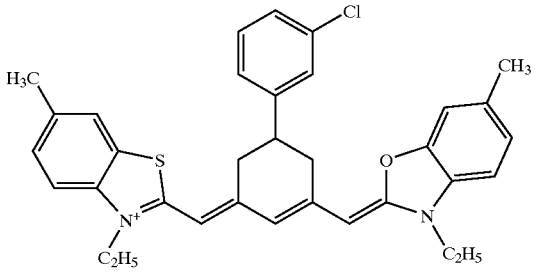
-continued
(IV-B-11)
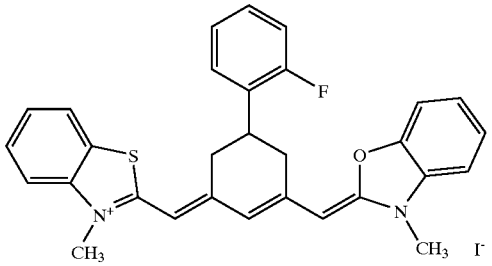
(IV-B-12)
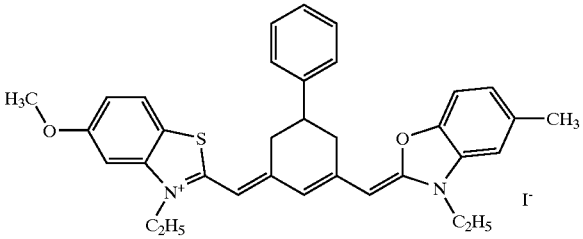
(IV-B-13)
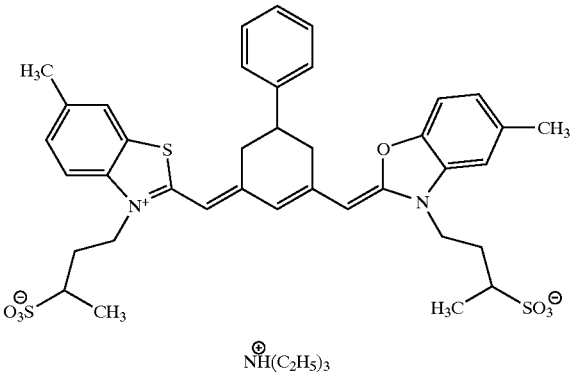
(IV-B-14)
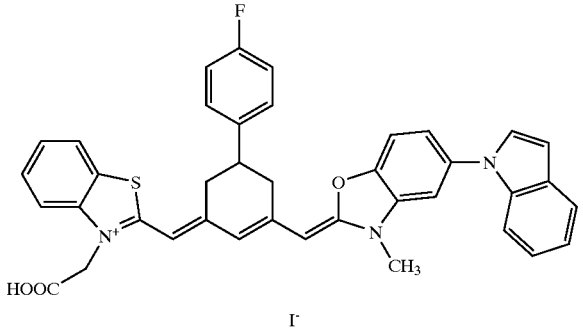
(IV-B-15)
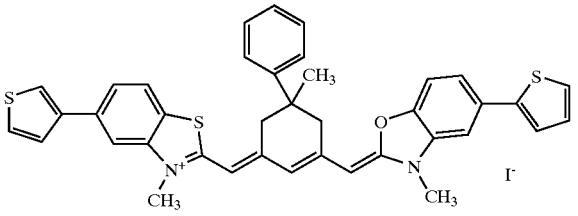

-continued (IV-B-16)

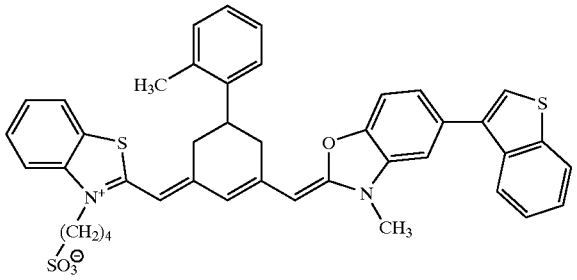

(IV-B-17)

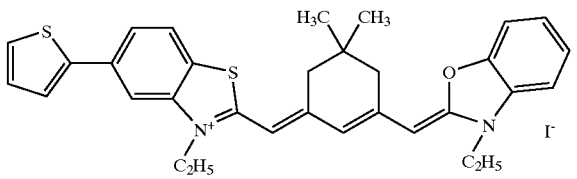

(IV-B-18)

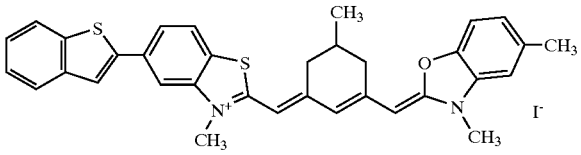

The sensitisers of formula (IV-A) are preferably used in an amount of 10 to 250 μmol, the sensitisers of formula (IV-B) in an amount of 5 to 200 μmol per mol silver halide.

In a particularly preferred embodiment the red-sensitive layer, in addition to the red-sensitisers of formulae (IV) and/or (IV-A) and/or (IV-B), contains a further red-sensitiser of formula (V)

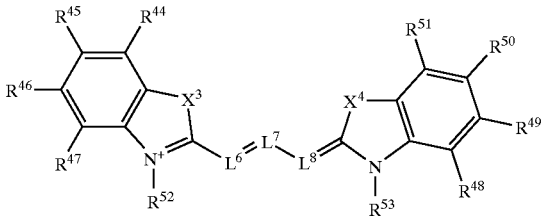

wherein $R^{44}$ to $R^{51}$ represent H, alkyl alkoxy, halogen, aryl, CN, 2- or 3-thienyl, N-pyrrolyl, N-indolyl, benzthienyl, $CF_3$, 2- or 3-furanyl or $R^{45}$ and $R^{46}$ or $R^{46}$ and $R^{47}$ or $R^{48}$ and $R^{49}$ or $R^{49}$ and $R^{50}$ represent the remaining members of a carbocyclic ring system, $X^3$ represents O, S, Se or N—$R^{54}$, $X^4$ represents 0 or N—$R^{55}$ $R^{52}$ and $R^{53}$ represent optionally substituted alkyl or $R^{52}$ together with $L^6$ or $R^{53}$ together with $L^8$ represent the remaining members of a 5- to 7-membered saturated or unsaturated ring, $L^6$ to $L^8$ represent optionally substituted methine groups, $R^{54}$ and $R^{55}$ represent $C_1$ to $C_4$ alkyl and M represents a counterion optionally necessary for charge compensation.

Particularly suitable sensitisers of formula (V) are given hereinafter (V-1)

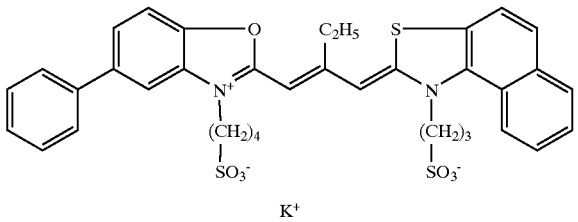

(V-2)

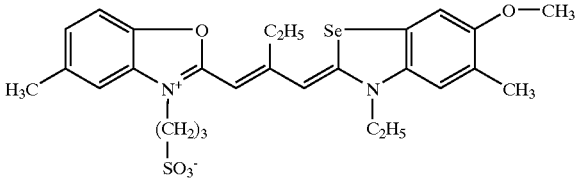

(V-3)

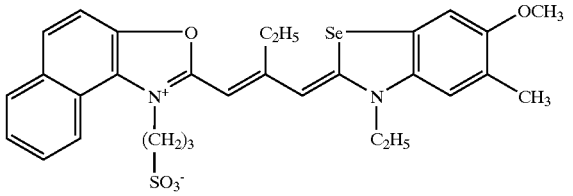

(V-4)

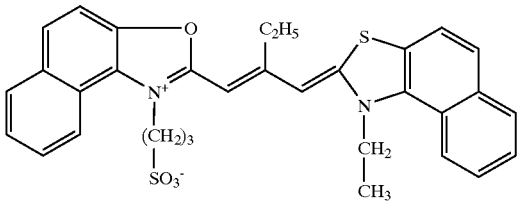

(V-5)

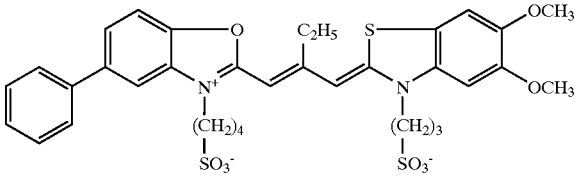

$(C_2H_5)_3\overset{+}{N}H$ (V-6)

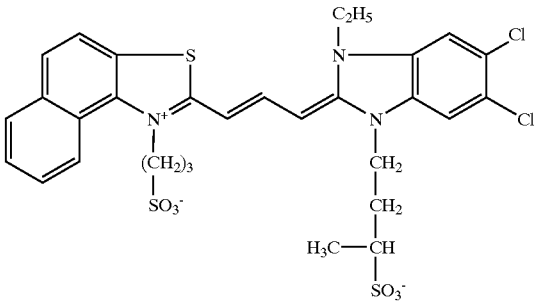

$(C_2H_5)_3\overset{+}{N}H$

-continued (V-7)

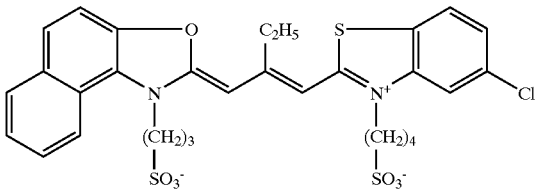

(V-8)

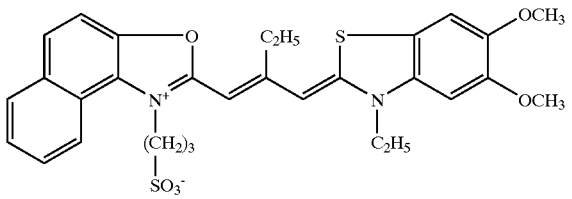

(V-9)

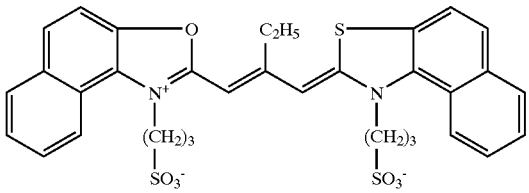

The invention also relates to a method for producing a positive image to be viewed by reflection of a colour negative, characterised in that a colour photographic material according to the invention is used.

In the method according to the invention, exposure is preferably carried out with a scanning or analogue copier.

The compounds of formulae 1 to 4 are added, in particular, after chemical digestion, compound (II) optionally also during chemical digestion.

In a preferred embodiment the silver halide crystals of the red-sensitive layer are doped with iridium.

The iridium may be incorporated into the crystals in any known manner. It is preferably added as a complex salt in dissolved form at any time during emulsion production, in particular before the end of precipitation.

In a preferred embodiment iridium (III)- and/or iridium (IV)-complexes are used, complexes with chloroligands being preferred. Hexachloro iridium (III)- and hexachloro iridium (IV)-complexes are preferred. The counterions to the iridium complex ions optionally required for charge compensation do not influence the effect according to the invention and may be selected freely.

Further preferred embodiments of the invention may be found in the sub-claims.

Examples of colour photographic copying materials are colour photographic paper, colour reversal photographic paper, semi-transparent display material and colour photographic materials with workable bases, for example made of PVC. An overview may be found in Research Disclosure 37038 (1995), Research Disclosure 38957 (1996) and Research Disclosure 40145 (1997).

The photographic copier materials consist of a substrate to which at least one light-sensitive silver halide emulsion layer is applied. In particular thin films and foils are suitable as substrates. An overview of substrate materials and auxiliary layers applied to the front and back thereof is given in Research Disclosure 37254, part 1 (1995), page 285 and in Research Disclosure 38957, part XV (1996), page 627.

The colour photographic copier materials conventionally contain at least one respective red-sensitive, green-sensitive and blue-sensitive silver halide emulsion layer and optionally intermediate layers and protective layers.

These layers may be arranged differently, depending on the type of photographic copying material. This is shown for the most important products:

Colour photographic paper and colour photographic display material in the sequence on the substrate given below conventionally have a respective blue-sensitive, yellow-coupling silver halide emulsion layer, a green-sensitive, magenta-coupling silver halide emulsion layer and a red-sensitive, cyan-coupling silver halide emulsion layer. A yellow filter layer is not necessary.

Deviations from the number and arrangement of the light-sensitive layers may be made to achieve specific results. For example colour papers may also contain intermediate layers sensitised in a different way, via which the gradation may be influenced.

Binders, silver halide particles and colour couplers are essential components of the photographic emulsion layers.

Details on suitable binders may be found in Research Disclosure 37254, part 2 (1995), page 286 and in Research Disclosure 38957, part II.A (1996), page 598.

Details on suitable silver halide emulsions, their production, digestion, stabilisation and spectral sensitisation, including suitable spectral sensitisers, may be found in Research Disclosure 37254, part 3 (1995), page 286, in Research Disclosure 37038, part XV (1995), page 89 and in Research Disclosure 38957, part V.A (1996), page 603.

Pentamethine cyanins with naphthothiazole, naphthoxazole or benzthiazole as basic terminal groups may also be used as red-sensitisers for the red-sensitive layer, which may be substituted by halogen, methyl or methoxy groups and may be 9,11-alkylene-, in particular 9,11-neopentylene-bridged.

The N,N'-substituents may be $C_4$ to $C_8$ alkyl groups. The methine chain may also carry substituents. Pentamethines with only one methyl group on the cyclohexene ring may also be used. The red-sensitiser may be supersensitised by adding hetrocyclic mercapto compounds and stabilised.

The red-sensitive layer may additionally be spectrally sensitised between 390 and 590 nm, preferably at 500 nm, in order to bring about improved differentiation of the red tones.

The spectral sensitisers may be added to the photographic emulsion in dissolved or dispersed form. Both solution and dispersion may contain additives such as wetting agents or buffers.

The spectral sensitisers or a combination of spectral sensitisers may be added before, during or after preparation of the emulsion.

Photographic copying materials contain either silver chloride bromide emulsions with up to 80 mol % AgBr or silver chloride bromide emulsions with over 95 mol % AgCl.

Details on the colour couplers may be found in Research Disclosure 37254, part 4 (1995), page 288, in Research Disclosure 37038, part II (1995), page 80 and in Research Disclosure 38957, part X.B (1996), page 616. The maximum absorption of the colours formed from the couplers and the colour developer oxidation product is, for copying materials, preferably in the following ranges: yellow coupler 440 to 450 nm, magenta coupler 540 to 560 nm, cyan coupler 625 to 670 nm.

The yellow couplers conventionally used in copying materials in association with a blue-sensitive layer are virtually always two-equivalent couplers of the pivaloylacetanilide and cyclopropylcarbonylacetanilide series.

The magenta couplers conventional in copying materials are virtually always those from the series of anilinopyrazolones, the pyrazolo[5,1-c](1,2,4)triazoles or the pyrazolo[1,5-b](1,2,4)triazoles.

The non-light-sensitive intermediate layers generally arranged between layers of different spectral sensitivity may contain agents to prevent undesired diffusion of developer oxidation products from one light-sensitive layer into another light-sensitive layer with different spectral sensitisation.

Suitable compounds (white couplers, scavengers or EOP catchers) may be found in Research Disclosure 37254, part 7 (1995), page 292, in Research Disclosure 37038, part III (1995), page 84 and in Research Disclosure 38957, part X.D (1996), S. 621 ff.

The photographic material may also contain UV light absorbing compounds, optical brighteners, spacers, filter colours, formalin scavengers, light stabilisers, antioxidants, $D_{Min}$-colours, softeners (latices), biocides and additives for improving the coupler and colour stability, for reducing the colour haze and for reducing the yellowing, etc. Suitable compounds may be found in Research Disclosure 37254, part 8 (1995), page 292, in Research Disclosure 37038, parts IV, V, VI, VII, X, XI and XIII (1995), page 84 ff and in Research Disclosure 38957, parts VI, VIII, IX and X (1996), page 607 and 601 ff.

The layers of colour photographic materials are conventionally hardened, i.e. the binder used, preferably gelatin, is crosslinked by suitable chemical processes.

Suitable hardener substances may be found in Research Disclosure 37254, part 9 (1995), page 294, in Research Disclosure 37038, part XII (1995), page 86 and in Research Disclosure 38957, page II.B (1996), page 599.

In terms of image-wise exposure, colour photographic materials are processed by different processes according to their character. Details on procedures and chemicals required for them are published in Research Disclosure 37254, page 10 (1995), page 294, in Research Disclosure 37038, parts XVI to XXIII (1995), page 95 ff and in Research Disclosure 38957, parts XVIII, XIX and XX (1996), page 630 ff, together with exemplary materials.

EXAMPLES

Emulsions

Production of Silver Halide Emulsions

Micrate Emulsion (EmM1) (Dopant-free Micrate) Emulsion)

The following solutions were prepared with demineralised water:

| | | |
|---|---|---|
| Solution 01 | 5500 g | Water |
| | 700 g | Gelatin |
| | 5 g | n-Decanol |
| | 20 g | NaCl |
| Solution 02 | 9300 g | Water |
| | 1800 g | NaCl |
| Solution 03 | 9000 g | Water |
| | 5000 g | $AgNO_3$ |

Solutions 02 and 03 were added to solution 01 at 40° C., over a period of 30 minutes at a constant feed rate of pAg 7.7 and pH 5.3 with simultaneous intensive stirring. During precipitation the pAg value was kept constant by adding a NaCl solution and the pH value was kept constant by adding $H_2SO_4$ to the precipitation tank. An AgCl emulsion with a mean particle diameter of 0.09 μm was obtained. The gelatin/$AgNO_3$ ratio by weight was 0.14. The emulsion was ultrafiltered at 50° C. and redispersed with sufficient gelatin and water that the gelatin/$AgNO_3$ ratio by weight was 0.3 and the emulsion contained 200 g AgCl per kg. After redispersion the particle size was 0.13 μm.

Red-sensitive Emulsions EmR1–EmR9

EmR1

The following solutions were prepared with demineralised water:

| | | |
|---|---|---|
| Solution 11 | 11000 g | Water |
| | 1360 g | Gelatin |
| | 5 g | n-Decanol |
| | 40 g | NaCl |
| | 1950 g | EmM1 |
| Solution 12 | 18600 g | Water |
| | 3600 g | NaCl |
| | 2820 μg | $K_2IrCl_6$ |
| Solution 13 | 18000 g | Water |
| | 10000 g | $AgNO_3$ |

Solutions 12 and 13 were added to solution 11 introduced into the precipitation tank at 40° C. over a period of 75 minutes at a pAg of 7.7 with simultaneous intensive stirring. The pAg and pH values were controlled as in the precipitation of emulsion EmM1. The feed was regulated in such a way that the feed rate of solutions 12 and 13 increased linearly in the first 50 minutes from 40 ml/min to 360 ml/min and in the remaining 25 minutes a constant feed rate of 400 ml/min was employed. An AgCl emulsion with a mean particle diameter of 0.495 μm was obtained. The gelatin/$AgNO_3$ ratio by weight was 0.14—the amount of AgCl in the emulsion will be converted hereinafter to $AgNO_3$. The emulsion was ultrafiltered, washed and redispersed with sufficient gelatin and water that the gelatin/$AgNO_3$ ratio by weight was 0.56 and the emulsion contained 200 g $AgNO_3$ per kg and 100 nmol $Ir^{4+}$ per mol AgCl.

The unmatured emulsions were divided into 20 portions with 2.5 kg each for further tests. Each portion corresponded to 0.5 kg $AgNO_3$.

2.5 kg of the emulsion was chemically matured at pH 5.0 with an optimal amount of gold (III) chloride and $Na_2S_2O_3$ for 2 hours at a temperature of 75° C. After chemical digestion the emulsion was spectrally sensitised at 40° C. with 50 μmol of compound (IV-A-1) per mol AgCl and stabilised with 200 mg of compound (II-8) and 1 g of compound (III-1) per kg $AgNO_3$. 3 mmol KBr were then added.

EmR2

As EmR1 but with the difference that the amount of compound (II-8) was increased from 200 mg to 1,000 mg.

EmR3

As EmR1 but with the difference that the amount of compound (II-8) was increased from 200 mg to 2,000 mg.

EmR4

As EmR2 but without compound (III-1).

EmR5

As EmR4 but compound (II-8) was replaced with 1 g of compound (II-14).

EmR6

As EmR2 but without compound (II-8).

EmR7

As EmR1 but the sensitiser (IV-A-1) was replaced by 50 μmol sensitiser (IV-A-3).

EmR8

As EmR1 but the sensitiser (IV-A-1) was replaced with 50 μmol sensitiser (IV-B-7).

EmR9

As EmR1 but 50% of the amount of the sensitiser (IV-A-1) was replaced with 25 μmol sensitiser (IV-B-7).

Green-sensitive Emulsion EmG1

Precipitation, desalination and redispersion proceed as in the red-sensitive emulsion EmR2. The emulsion is optimally matured at a pH of 5.3 with gold (III) chloride and $Na_2S_2O_3$ at a temperature of 60° C., for 2 hours. After chemical digestion the emulsion is spectrally sensitised at 50° C. with 0.6 mmol of compound (GS-1) per mol AgCl, stabilised with 1.2 mmol of compound (II-7) and then combined with 1 mmol KBr.

GS-1:

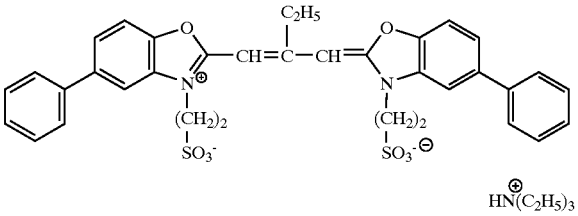

Blue-sensitive emulsion EmB1

The following solutions were prepared with demineralised water:

| | | |
|---|---|---|
| Solution 21 | 5500 g | Water |
| | 680 g | Gelatin |
| | 5 g | n-Decanol |
| | 20 g | NaCl |
| | 180 g | EmM1 |
| Solution 22 | 9300 g | Water |
| | 1800 g | NaCl |
| | 28 μg | $K_2IrCl_6$ |
| Solution 23 | 9000 g | Water |
| | 5000 g | $AgNO_3$ |

Solutions 22 and 23 were added to solution 21 introduced into the precipitation tank at 50° C. over a period of 150 minutes at a pAg of 7.7 with simultaneous intensive stirring. The pAg and pH values were controlled as in the precipitation of emulsion EmM1. The feed was regulated in such a way that the feed rate of solutions 22 and 23 increased linearly in the first 100 minutes from 10 ml/min to 90 ml/min and in the remaining 50 minutes a constant feed rate of 100 ml/min was employed. An AgCl emulsion with a mean particle diameter of 0.85 μm was obtained. The gelatin/$AgNO_3$ ratio by weight was 0.14. The emulsion contained 10 nmol $Ir^{4+}$ per mol AgCl. The emulsion was ultrafiltered and redispersed with sufficient gelatin and water that the gelatin/$AgNO_3$ ratio by weight was 0.56 and the emulsion contained 200 g $AgNO_3$ per kg.

The emulsion was matured for 2 hours at a pH of 5.3 with an optimal amount of gold (III) chloride and $Na_2S_2O_3$ at a temperature of 50° C. After chemical digestion the emulsion was spectrally sensitised at 40° C. with 0.3 mmol of compound BS-1 per mol AgCl, stabilised with 0.5 mmol of compound (II-8) and then combined with 0.6 mmol KBr.

BS-1:

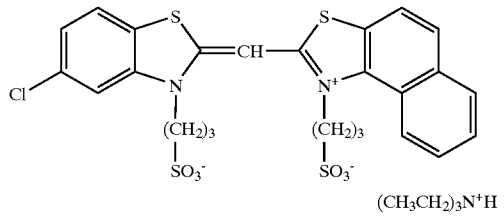

Layer Construction

Example 1

A colour photographic recording material suitable for high-speed processing was produced by applying the following layers in the given sequence to a substrate made of paper coated with polyethylene on both sides. The amounts are based on 1 $m^2$ in each case. The corresponding amounts of $AgNO_3$ are given for the silver halide application.

| Layer construction 101 | |
|---|---|
| Layer 1: | (substrate layer) |
| | 0.10 g gelatin |
| Layer 2: | (blue-sensitive layer) |
| | blue-sensitive silver halide emulsion EmB1 |
| | (99.94 mol % chloride, 0.06 mol % bromide, |
| | mean particle diameter 0.085 μm) consisting of |
| | 0.4 g $AgNO_3$. |
| | 1.25 g gelatin |
| | 0.30 g yellow coupler GB-1 |
| | 0.20 g yellow coupler GB-2 |
| | 0.30 g tricresylphosphate (TCP) |
| | 0.10 g stabiliser ST-1 |
| Layer 3: | (intermediate layer) |
| | 0.10 g gelatin |
| | 0.06 g EOP-scavenger SC-1 |
| | 0.06 g EOP-scavenger SC-2 |
| | 0.12 g TCP |
| Layer 4: | (green-sensitive layer) |
| | green-sensitive silver halide emulsion EmG1 |
| | (99.9 mol % chloride, 0.1 mol % bromide, |
| | mean particle diameter 0.495 μm) consisting of 0.2 g |
| | $AgNO_3$. |
| | 1.10 g gelatin |
| | 0.05 g magenta coupler PP-1 |
| | 0.10 g magenta coupler PP-2 |
| | 0.15 g stabiliser ST-2 |
| | 0.20 g stabiliser ST-3 |
| | 0.40 g TCP |
| Layer 5: | (UV-protective layer) |
| | 1.05 g gelatin |
| | 0.35 g UV-absorber UV-1 |
| | 0.10 g UV-absorber UV-2 |
| | 0.05 g UV-absorber UV-3 |
| | 0.06 g EOP-scavenger SC-1 |
| | 0.06 g EOP-scavenger SC-2 |
| | 0.25 g TCP |
| Layer 6: | (red-sensitive layer) |
| | Red-sensitive silver halide emulsion EmR1 |
| | (99.7 mol % chloride, 0.3 mol % bromide, |
| | mean particle diameter 0.495 μm) consisting of |
| | 0.28 g $AgNO_3$. |
| | 1.00 g gelatin |
| | 0.40 g cyan coupler BG-1 |
| | 0.20 g TCP |
| | 0.20 g dibutylphthalate |
| Layer 7: | (UV-protective layer) |
| | 1.05 g gelatin |
| | 0.35 g UV-absorber UV-1 |
| | 0.10 g UV-absorber UV-2 |
| | 0.05 g UV-absorber UV-3 |
| | 0.15 g TCP |

-continued

| Layer construction 101 | |
|---|---|
| Layer 8: | (protective layer)<br>0.90 g gelatin<br>0.05 g optical brightener W-1<br>0.07 g polyvinylpyrrolidone<br>1.20 ml silicone oil<br>2.50 mg spacers consisting of polymethylmethacrylate, mean particle size 0.8 $\mu$m<br>0.30 g instant hardening agent H-1 |

The further layer constructions differ from 101 owing to the cyan emulsion EmR1 to EmR9 indicated in the table and the cyan coupler in layer 6.

TABLE 1

| | Layer 6 | | |
|---|---|---|---|
| Layer construction | Cyan coupler | Red-sensitive emulsion | |
| 101 | BG-1 | EmR1 | Comparison |
| 102 | BG-1 | EmR2 | Comparison |
| 103 | BG-1 | EmR3 | Comparison |
| 104 | BG-1 | EmR4 | Comparison |
| 105 | BG-1 | EmR5 | Comparison |
| 106 | BG-1 | EmR6 | Comparison |
| 107 | BG-1 | EmR7 | Comparison |
| 108 | BG-1 | EmR8 | Comparison |
| 109 | BG-1 | EmR9 | Comparison |
| 111 | I-1 | EmR1 | Invention |
| 112 | I-1 | EmR2 | Invention |
| 113 | I-1 | EmR3 | Invention |
| 114 | I-1 | EmR4 | Invention |
| 115 | I-1 | EmR5 | Invention |
| 116 | I-1 | EmR6 | Comparison |
| 117 | I-1 | EmR7 | Invention |
| 118 | I-1 | EmR8 | Invention |
| 119 | I-1 | EmR9 | Invention |

The results of the tests described hereinafter on these layer constructions are summarised in Table 2.

White Exposure

To determine the photographic properties after analogue exposure the samples were exposed behind a graduated grey wedge with a density gradation of 0.1/step 40 ms at a constant amount of light from a halogen lamp.

Selective Exposure

To determine the colour reproduction of cyan, samples of the material were exposed behind a grey wedge and through a red filter with an exposure time of 40 ms.

Chemical processing

All samples were processed as follows.

| | | |
|---|---|---|
| a) | Colour developer 45 s 35° C. | |
| | Triethanolamine | 9.0 g |
| | N,N-Diethylhydroxylamine | 4.0 g |
| | Diethyleneglycol | 0.05 g |
| | 3-Methyl-4-amino-N-ethyl-N-methane-sulphonamidoethyl-aniline-sulphate | 5.0 g |
| | Potassium sulphite | 0.2 g |
| | Triethyleneglycol | 0.05 g |
| | Potassium carbonate | 22 g |
| | Potassium hydroxide | 0.4 g |
| | Ethylenediaminetetraacetic acid-di-Na-salt | 2.2 g |
| | Potassium chloride | 2.5 g |
| | 1,2-Dihydroxybenzene-3,4,6-trisulphonic acid trisodium salt | 0.3 g |
| | topped up with water to 1,000 ml; pH 10.0 | |
| b) | Bleach fixing bath 45 s 35° C. | |
| | Ammoniumthiosulphate | 75 g |
| | Sodium hydrogen sulphate | 13.5 g |
| | Ammoniumacetate | 2.0 g |
| | Ethylenediaminetetraacetic acid (iron-ammonium-salt) | 57 g |
| | Ammonia 25% | 9.5 g |
| | topped up with vinegar to 1,000 ml; pH 5.5 | |
| c) | Rinsing 2 min 33° C. | |
| d) | Drying | |

The results of analogue exposure are presented in the form of the following parameters:

| | |
|---|---|
| Gamma value G1: | heavy gradation: is the incline of the secant between the sensitivity point with density D = Dmin + 0.10 and the curve point with density D − Dmin + 0.85. |
| Gamma value G2: | middle gradation: is the incline of the secant between the sensitivity point with density D = Dmin + 0.85 and the curve point with density D = Dmin + 1.60. |
| Δ G1: | threshold gradation after 4 weeks' storage at 37° C. minus threshold gradation after 1 day |
| Δ G2: | shoulder gradation after 4 weeks' storage at 37° C. minus shoulder gradation after 1 day. |

Latent Image Behaviour

The unprocessed samples from the layer construction were similarly exposed in a sensitometer. After 5 sec and after 5 min the exposed samples were processed by the above-mentioned method. The cyan colour densities of a grey patch with a density of about 0.5 were then measured. The change in density as a function of the dwell time between exposure and processing corresponds to the latent image behaviour of the material.

The following compounds were used in examples 101 to 119:

GB-1

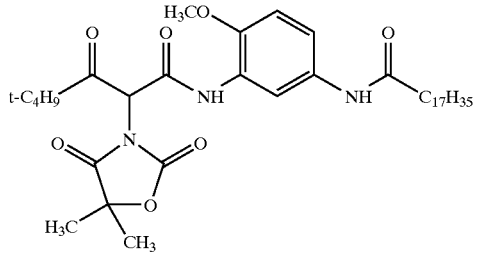

-continued
GB-2
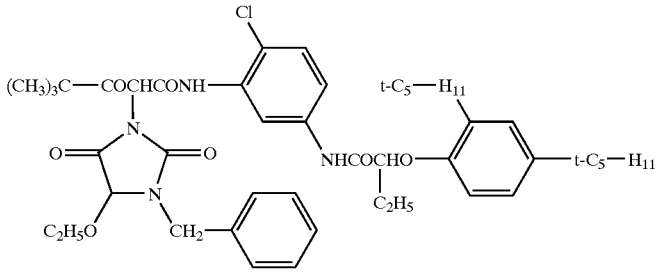
PP-1
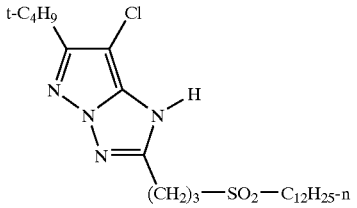
PP-2
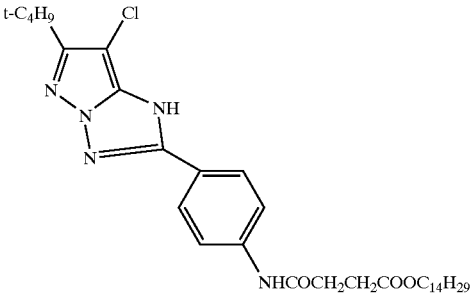
BG-1
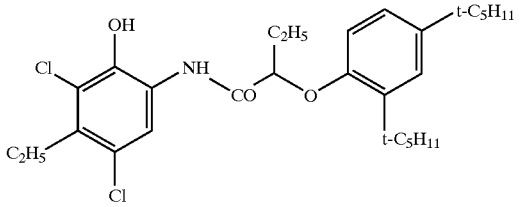
SC-1
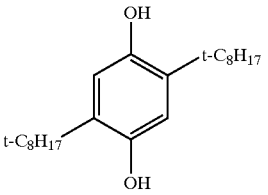
SC-2
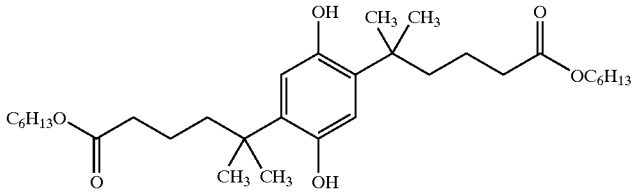
UV-1
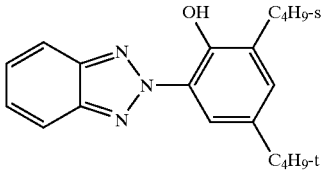
UV-2
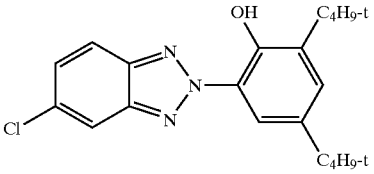
UV-3
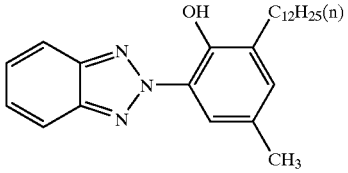
H-1
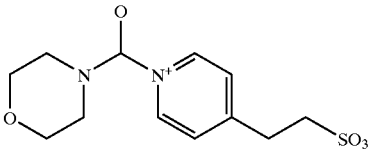
ST-1
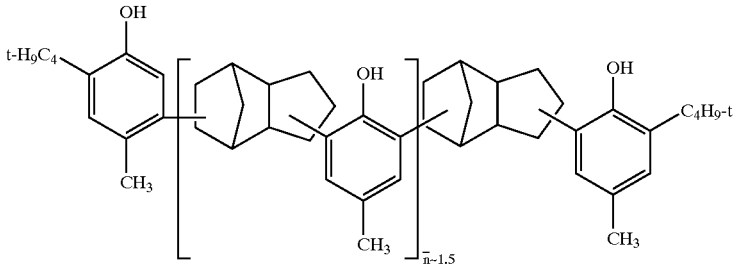

-continued

ST-2

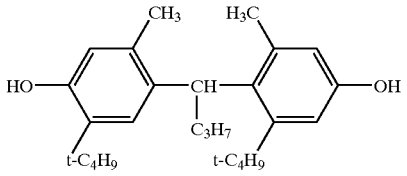

ST-3

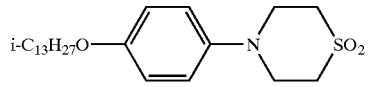

W-1

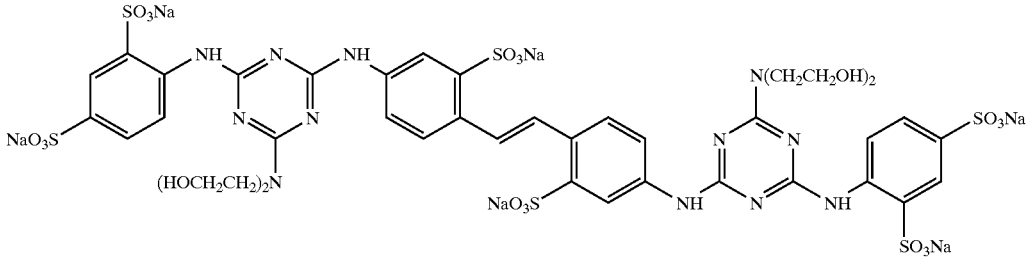

TABLE 2

| Layer construction | Cyan coupler | Red-sensitive emulsion | Stability after 4 weeks/37° C. storage Δ G1 | Δ G2 | Change in density after latent image time | |
|---|---|---|---|---|---|---|
| 101 | BG-1 | EmR1 | −0.08 | −0.16 | +0.05 | Comparison |
| 102 | BG-1 | EmR2 | −0.06 | −0.09 | −0.07 | Comparison |
| 103 | BG-1 | EmR3 | −0.04 | −0.09 | −0.10 | Comparison |
| 104 | BG-1 | EmR4 | −0.07 | −0.12 | +0.08 | Comparison |
| 105 | BG-1 | EmR5 | −0.06 | −0.13 | +0.09 | Comparison |
| 106 | BG-1 | EmR6 | −0.15 | −0.22 | +0.01 | Comparison |
| 107 | BG-1 | EmR7 | −0.07 | −0.17 | +0.06 | Comparison |
| 108 | BG-1 | EmR8 | −0.08 | −0.13 | +0.08 | Comparison |
| 109 | BG-1 | EmR9 | −0.10 | −0.15 | +0.08 | Comparison |
| 111 | I-1 | EmR1 | −0.03 | −0.12 | −0.02 | Invention |
| 112 | I-1 | EmR2 | −0.03 | −0.08 | +0.02 | Invention |
| 113 | I-1 | EmR3 | −0.02 | −0.09 | +0.04 | Invention |
| 114 | I-1 | EmR4 | −0.04 | −0.11 | +0.02 | Invention |
| 115 | I-1 | EmR5 | −0.05 | −0.10 | +0.04 | Invention |
| 116 | I-1 | EmR6 | −0.16 | −0.21 | −0.01 | Comparison |
| 117 | I-1 | EmR7 | −0.06 | −0.14 | +0.00 | Invention |
| 118 | I-1 | EmR8 | −0.07 | −0.11 | +0.02 | Invention |
| 119 | I-1 | EmR9 | −0.08 | −0.13 | −0.01 | Invention |

The results show clearly that the stability in storage, shown in Table 2 by Δ G1 and Δ G2, may be much improved by adding compounds of formula (II), but that this normally results in poor latent image stability.

Very good stability in storage and simultaneous outstanding latent image stability are achieved only with the couplers of structure (I).

What is claimed is:

1. Colour photographic silver halide material comprising a substrate, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the silver halide crystals of the red-sensitive layer have a chloride content of at least 95 mol %, the cyan coupler corresponding to formula (I)

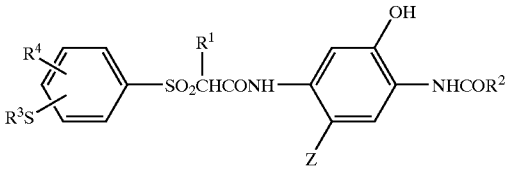

wherein $R^1$ represents a hydrogen atom or an alkyl group, $R^2$ represents an alkyl, aryl or hetaryl group $R^3$ represents an alkyl or aryl group, $R^4$ represents an alkyl, alkenyl, alkoxy, aryloxy, acyloxy, acylamino, sulphonyloxy, sulphamoylamino, sulphonamido, ureido, hydroxycarbonyl, hydroxycarbonylamino, carbamoyl, alkylthio, arylthio, alkylamino or arylamino group or a hydrogen atom and Z represents a hydrogen atom or a group which may be split off under the conditions of chromogenic development and the red-sensitive layer contains at least one compound of formula (II)

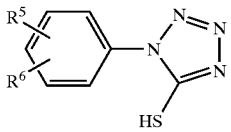

wherein $R^5$ represents H, $CH_3$ or $OCH_3$, $R^6$ represents H, OH, $CH_3$, $OCH_3$, NHCO—$R^7$, $COOR^7$, $SO_2NH_2$, $NHCONH_2$ or NHCONH—$CH_3$ and $R^7$ represents $C_1$ to $C_4$ alkyl.

2. The material according to claim 1, wherein the cyan coupler corresponds to formula (I-A)

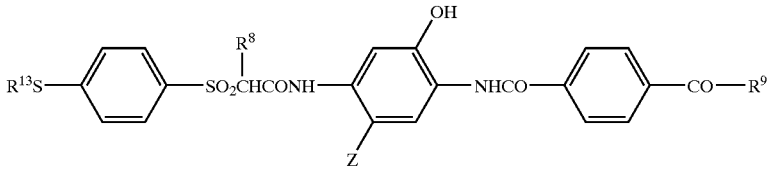

$R^8$ represents a hydrogen atom or an alkyl group, $R^9$ represents $OR^{10}$ or $NR^{11}R^{12}$, $R^{10}$ represents an unsubstituted or substituted alkyl group with 1 to 6 carbon atoms, $R^{11}$ represents are unsubstituted or substituted alkyl group with 1 to 6 carbon atoms, $R^{12}$ represents a hydrogen atom or an unsubstituted or substituted alkyl group with 1 to 6 carbon atoms, $R^{13}$ represents an unsubstituted or substituted alkyl group and Z represents a hydrogen atom or a group which may be split off under the conditions of chromogenic development, wherein the total number of carbon atoms of the alkyl group $R^{10}$ to $R^{13}$ in a coupler molecule is 8 to 18.

3. The material according to claim 1, wherein the amount of compound (II) is 50 mg to 5,000 mg per kg Ag.

4. The material according to claim 3, wherein the amount of compound (II) is 200 mg to 2,000 mg per kg Ag.

5. The material according to claim 1, wherein the red-sensitive layer contains at least one compound of formula (III)

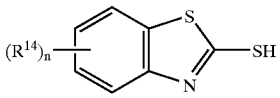

wherein $R^{14}$ represents a substituent and n represents a number 1, 2 or 3.

6. The material as claimed in claim 5, wherein the compound of formula III is

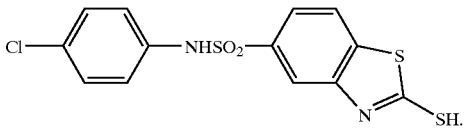

7. The material according to claim 5, wherein the amount of compound (III) is 100 mg to 5,000 mg per kg Ag.

8. The material according to claim 5, wherein the amount of compound (III) is 500 mg to 3,000 mg per kg Ag.

9. The material according to claim 1, wherein the red-sensitive layer contains a compound of formula (IV)

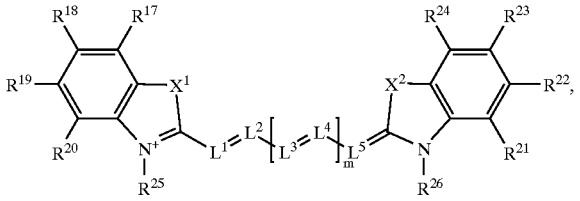

M wherein $R^{17}$ to $R^{24}$ independently represent H, alkyl, alkoxy, halogen, aryl, CN, 2-thienyl, 3-thienyl, N-pyrrolyl, N-indolyl, benzthienyl, $CF_3$, 2-furanyl or 3-furanyl or $R^{18}$ and $R^{19}$ or $R^{19}$ and $R^{20}$ or $R^{21}$ and $R^{22}$ and $R^{23}$ represent the remaining members of a carbocyclic ring system, $X^1$ and $X^2$ independently represent O, S, Se or N—$R^{27}$, $R^{25}$ and $R^{26}$ independently represent optionally substituted alkyl or $R^{25}$ together with $L^1$ or $R^{26}$ together with $L^5$ represent the remaining members of a 5- to 7-membered saturated or unsaturated ring, $L^1$ to $L^5$ independently represent optionally substituted methine groups of $L^2$, $L^3$ and $L^4$ together represent the members of a 5- to 7-membered ring, m represents 0 to 1, $R^{27}$ represents $C_1$ to $C_4$ alkyl and M represents a counterion optionally necessary for charge compensation, wherein $X^1$ and $X^2$ independently of one another represent S or Se if m is 0.

10. The material according to claim 9, wherein the compound (IV) was used in an amount of 5 $\mu$mol to 250 $\mu$mol per mol silver halide.

11. The material according to claim 9, wherein the red-sensitive layer contains a compound of formula (V)

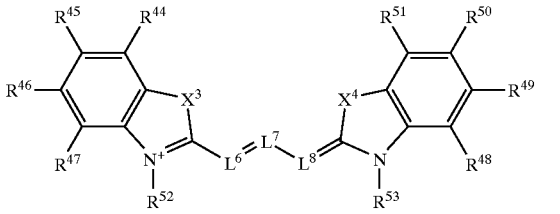

M wherein $R^{44}$ to $R^{51}$ independently represent H, alkyl, alkoxy, halogen, aryl, CN, 2-thienyl, 3-thienyl, N-pyrrolyl, N-indolyl, benzthienyl, $CF_3$, 2-furanyl or 3-furanyl or $R^{45}$ and $R^{46}$ or $R^{46}$ and $R^{47}$ or $R^{48}$ and $R^{49}$ or $R^{49}$ and $R^{50}$ represent the remaining members of a carbocyclic ring system, $X^3$ represents O, S, Se or N—$R^{54}$, $X^4$ represents 0 or N—$R^{55}$, $R^{52}$ and $R^{53}$ independently represent optionally substituted alkyl or $R^{52}$ together with $L^6$ or $R^{53}$ together with $L^8$ represent the remaining members of a 5- to 7-membered saturated or unsaturated ring, $L^6$ to $L^8$ independently represent optionally substituted methine groups, $R^{54}$ and $R^{55}$ independently represent $C_1$ to $C_4$ alkyl and M represents a counterion optionally necessary for charge compensation.

12. The material according to claim 9, wherein the compound (IV) is used in an amount of 50 $\mu$mol to 200 $\mu$mol per mol silver halide.

13. The material according to claim 1, wherein the material is a color negative material.

14. A method for producing a positive image to be viewed by reflection from a color negative, which comprises exposing the color photographic material according to claim 1.

15. The method according to claim 14, wherein exposing is carried out with a scanning copier.

16. The method according to claim 14, wherein exposing is carried out with an analogue copier.

* * * * *